US010391353B2

(12) United States Patent
McBride et al.

(10) Patent No.: US 10,391,353 B2
(45) Date of Patent: Aug. 27, 2019

(54) EXERCISE BOARD ASSEMBLY

(71) Applicant: STAMINA PRODUCTS, INC., Springfield, MO (US)

(72) Inventors: Robert McBride, Springfield, MO (US); Tyler Rogers, Springfield, MO (US); Peter Ploss, Springfield, MO (US); Taylor Hutchens, Springfield, MO (US); Newton Lin, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 191 days.

(21) Appl. No.: 15/294,193

(22) Filed: Oct. 14, 2016

(65) Prior Publication Data

US 2018/0104528 A1 Apr. 19, 2018

(51) Int. Cl.

| | |
|---|---|
| ***A63B 21/00*** | (2006.01) |
| ***A63B 23/04*** | (2006.01) |
| ***A63B 23/02*** | (2006.01) |
| ***A63B 23/12*** | (2006.01) |
| ***A63B 22/14*** | (2006.01) |

(Continued)

(52) U.S. Cl.

CPC ..... *A63B 21/4029* (2015.10); *A63B 23/0205* (2013.01); *A63B 23/0405* (2013.01); *A63B 23/1236* (2013.01); *A63B 22/14* (2013.01); *A63B 22/16* (2013.01); *A63B 22/18* (2013.01); *A63B 2023/0411* (2013.01); *A63B 2225/09* (2013.01)

(58) Field of Classification Search

CPC ... A63B 26/00; A63B 26/003; A63B 26/0205; A63B 21/4029; A63B 22/16; A63B 22/0056; A63B 2026/006; A63B 23/20–2011

See application file for complete search history.

(56) References Cited

U.S. PATENT DOCUMENTS

| | | | |
|---|---|---|---|
| D182,957 | S | 6/1958 | Harris et al. |
| D210,083 | S | 2/1968 | Werner |
| 3,545,748 | A | 12/1970 | Delinger |

(Continued)

FOREIGN PATENT DOCUMENTS

| | | | | |
|---|---|---|---|---|
| DE | 202013009232 | U1 * | 10/2013 | ..... A63B 21/023 |
| WO | WO-2007140503 | A1 * | 12/2007 | ..... A63B 21/0004 |

OTHER PUBLICATIONS

WO2007140503A1 WIPO English Translation (Year: 2019).*

*Primary Examiner* — Nyca T Nguyen

(74) *Attorney, Agent, or Firm* — Erise IP, P.A.

(57) ABSTRACT

Disclosed herein is an exercise board assembly that includes an exercise board, a support leg, and one or more rocker surface(s). The support leg is pivotally mounted to the exercise board and can be secured in at least two positions, including one to arrange the board in a stable angled configuration relative to a floor and a folded position. The support leg can be locked in a number of positions so that a user can perform different exercises using the exercise board. The rocker surface may support the exercise board on the floor surface when the support leg is in the folded position. When engaged with the floor, the rocker surface(s) cause the board to be unstable, thereby causing it to rock or tilt relative to the floor. Stops may be included to limit a range for rocking of the board relative to the floor surface.

23 Claims, 40 Drawing Sheets

(51) Int. Cl.
*A63B 22/16* (2006.01)
*A63B 22/18* (2006.01)

(56) References Cited

U.S. PATENT DOCUMENTS

| | | | | |
|---|---|---|---|---|
| 4,101,124 | A | 7/1978 | Mahnke | |
| 4,465,275 | A | 8/1984 | Lingelbach | |
| D279,810 | S | 7/1985 | Noble | |
| D366,917 | S | 2/1996 | Clem | |
| 5,931,768 | A | 8/1999 | Amesquita | |
| 5,957,955 | A | 9/1999 | Thomas | |
| 6,213,924 | B1 * | 4/2001 | Kaiyoorawongs ..... | A63B 22/14 482/146 |
| 7,294,097 | B2 | 11/2007 | Parker | |
| 7,878,961 | B2 | 2/2011 | Carlucci et al. | |
| 8,298,126 | B2 | 10/2012 | Berc | |
| 8,394,005 | B2 | 3/2013 | Solow et al. | |
| 9,022,911 | B2 | 5/2015 | Goldberg | |
| D768,792 | S | 10/2016 | Goldberg et al. | |
| D768,793 | S | 10/2016 | Goldberg et al. | |
| 2009/0270236 | A1 | 10/2009 | Berc | |
| 2010/0167887 | A1 * | 7/2010 | Berry ..... | A63B 22/18 482/147 |

* cited by examiner

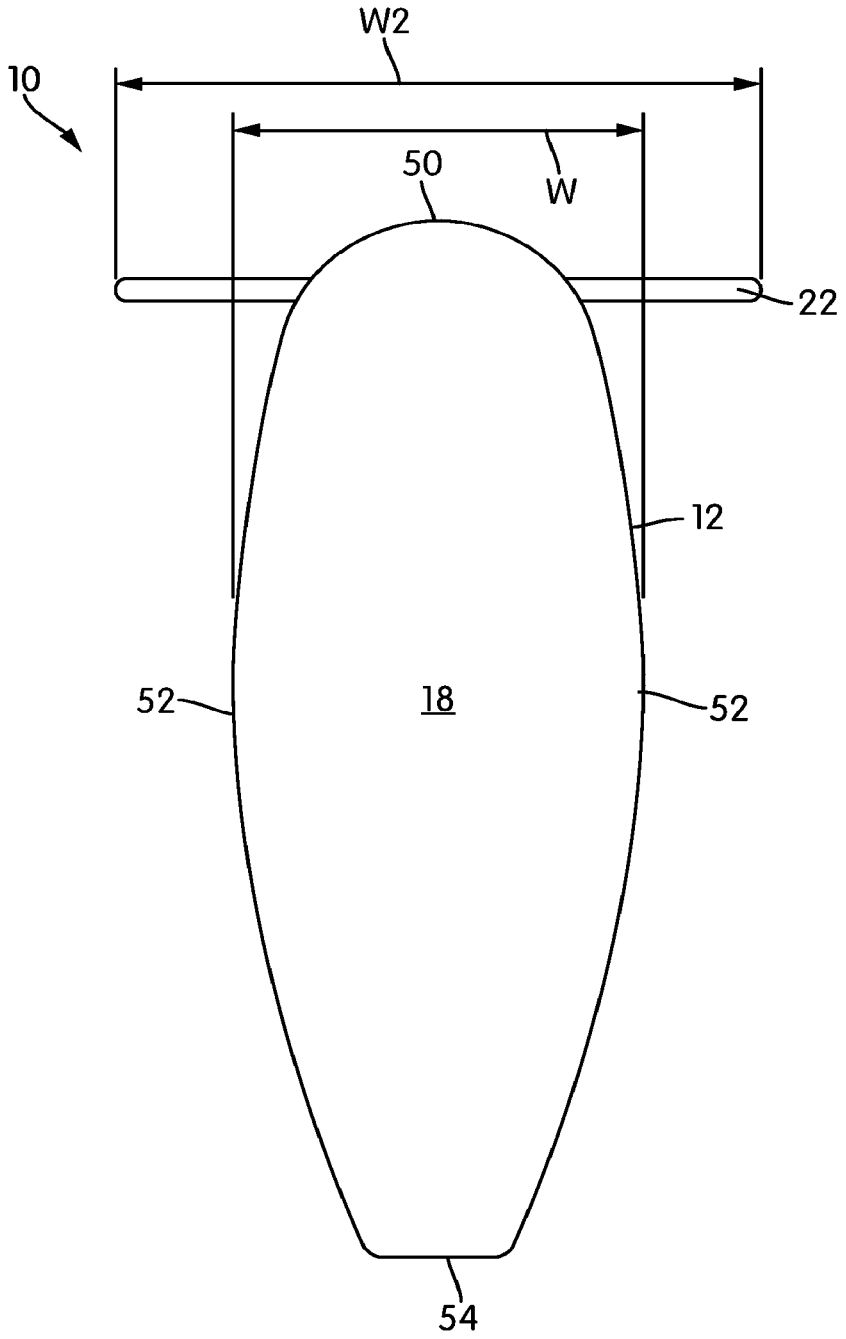
FIG. 2
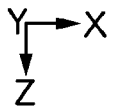

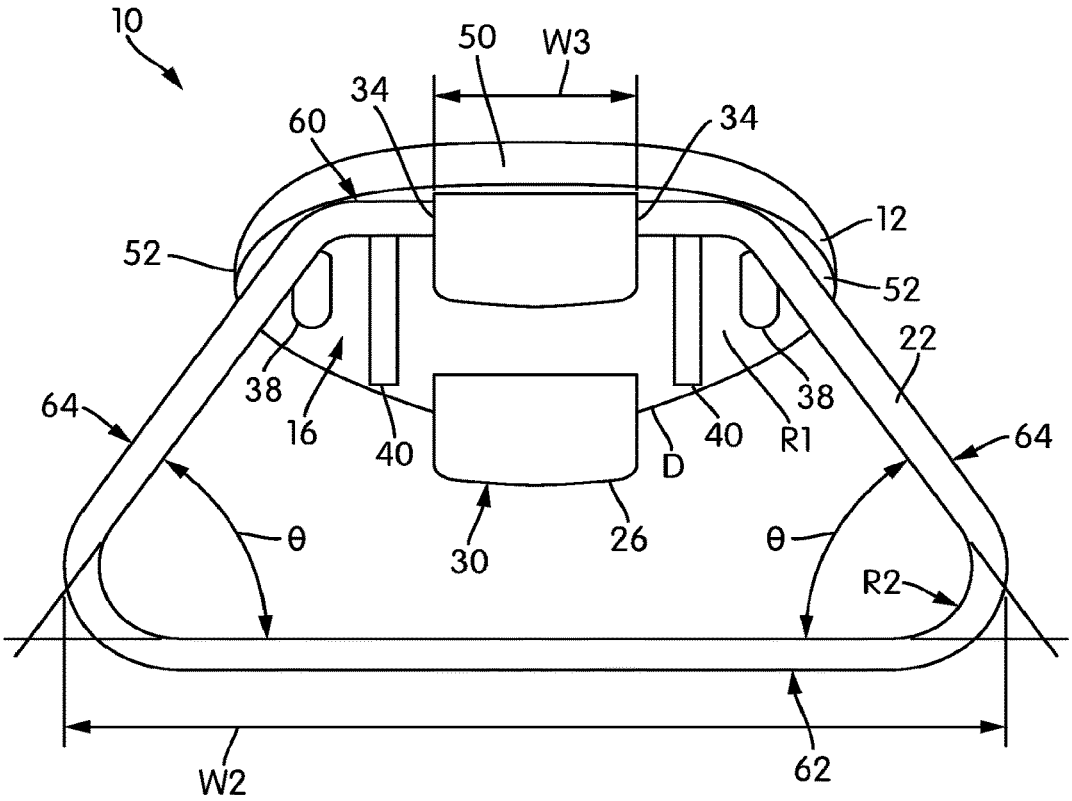
FIG. 5
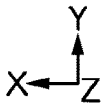

EXERCISE BOARD ASSEMBLY

BACKGROUND

Field

The present invention is generally related to an exercise board that can be configured into different positions and arrangements.

Description of Related Art

Exercise platforms can assist a user in performing exercises and isolate specific motions and movement of the user's body. Type of exercises performed with some known platforms, however, can be limited based on the design of the board.

SUMMARY

It is an aspect of this disclosure to provide an exercise board assembly that includes an exercise board, a support leg, and a rocker surface. The exercise board has a user support surface on a first side of the board and an opposite surface on a second side of the board opposite the first side. The support leg is pivotally mounted to the exercise board. The support leg is constructed and arranged to be secured in at least two positions, including a deployed, downwardly extended position, wherein the support leg is arranged to support the board in a stable angled configuration with respect to a floor surface on which the exercise board assembly is positioned, and a folded position. The rocker surface is constructed and arranged to support the exercise board on the floor surface when the support leg is in the folded position. The rocker surface is engageable with the floor surface to cause the user support surface to be unstable for a user supported thereby.

Another aspect provides an exercise board assembly that includes an exercise board, a support leg, and a rocker surface. The exercise board has a user support surface on a first side of the board and an opposite surface on a second side of the board opposite the first side. The support leg is pivotally mounted to the exercise board. The support leg is constructed and arranged to be secured in at least two positions, including a deployed, upwardly extended position, wherein the support leg is disposed in a position extending above the support surface to enable a user supported on the support surface to engage the support leg with the arms, hands, legs, or feet of the user, and a folded position. The rocker surface is constructed and arranged to support the exercise board on a floor surface when the support leg is in the deployed, upwardly extended position. The rocker surface is engageable with the floor surface to cause the user support surface to be unstable for a user supported thereby.

Other features and advantages of the present invention will become apparent from the following detailed description, the accompanying drawings, and the appended claims.

BRIEF DESCRIPTION OF THE DRAWINGS

FIGS. 1-3 show an isometric view, a top view, and a side view of an exercise board assembly with a support leg in a first position in accordance with an embodiment of this disclosure.

FIG. 5 is a top end view of the exercise board assembly of FIG. 1.

DETAILED DESCRIPTION OF THE PREFERRED EMBODIMENT(S)

Figure 1:
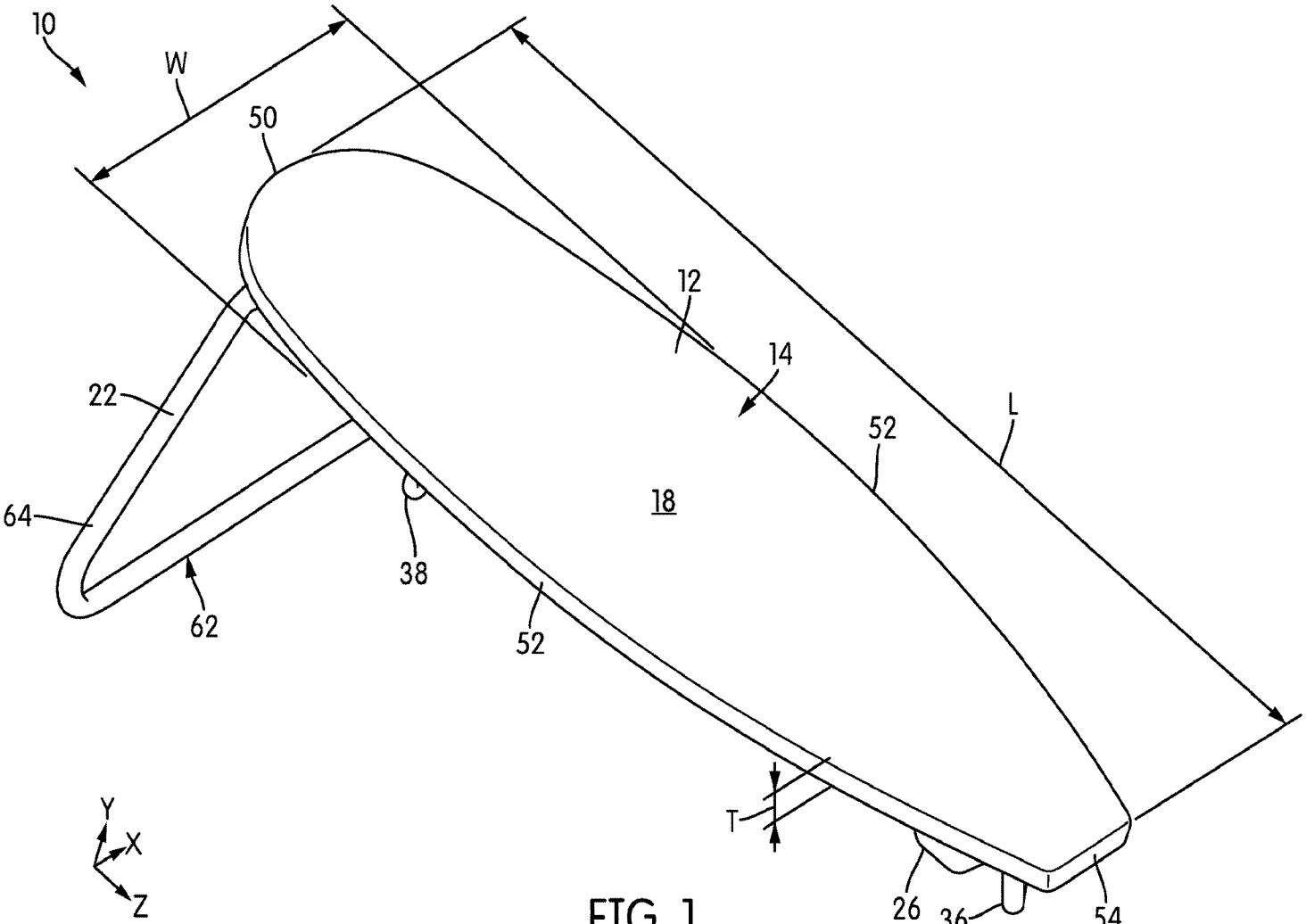

Disclosed herein is an exercise board assembly 10. The exercise board assembly 10 is designed for allowing a user to perform multiple exercises therewith.

FIGS. 1-13 illustrate one exemplary embodiment of the exercise board assembly 10. Exercise board assembly 10 includes an exercise board 12, a support leg 22, and at least one rocker surface 28 provided, for example, via a rocker block 24.

The exercise board 12 includes a user support surface 18 on a first side 14 of the board 12, and an opposite surface 20 on a second side 16 (or underside) of the board 12 that is opposite the first side 14. As seen in FIG. 1 and FIG. 2, for example, in one embodiment, the exercise board 12 may be shaped like a surfboard, with a rounded top edge 50 at a first end (or top or proximal end), convexly curved side edges 52, and a flat bottom edge 54 at a second end (or bottom or distal end). The surfaces 18, 20 of the first and second sides 14, 16 may be flat in one embodiment. In another embodiment, described later, the surfaces may be curved (e.g., see FIGS. 27 and 30). The exercise board 12 has a length L extending in a longitudinal direction (see FIG. 1). In an embodiment, the length L of the board 12 is between approximately 55 inches and approximately 75 inches (both inclusive). The exercise board 12 has a width W extending in a lateral direction measured between widest points of the board, for example. In an embodiment, the width W of the board 12 is between approximately 24 inches and approximately 28 inches (both inclusive). A thickness T of the exercise board 12 may vary. In an embodiment, the thickness T of the board 12 is between approximately 1½ inches and approximately 2½ inches (both inclusive). In one embodiment, the thickness T is approximately 2 inches.

Figure 3:
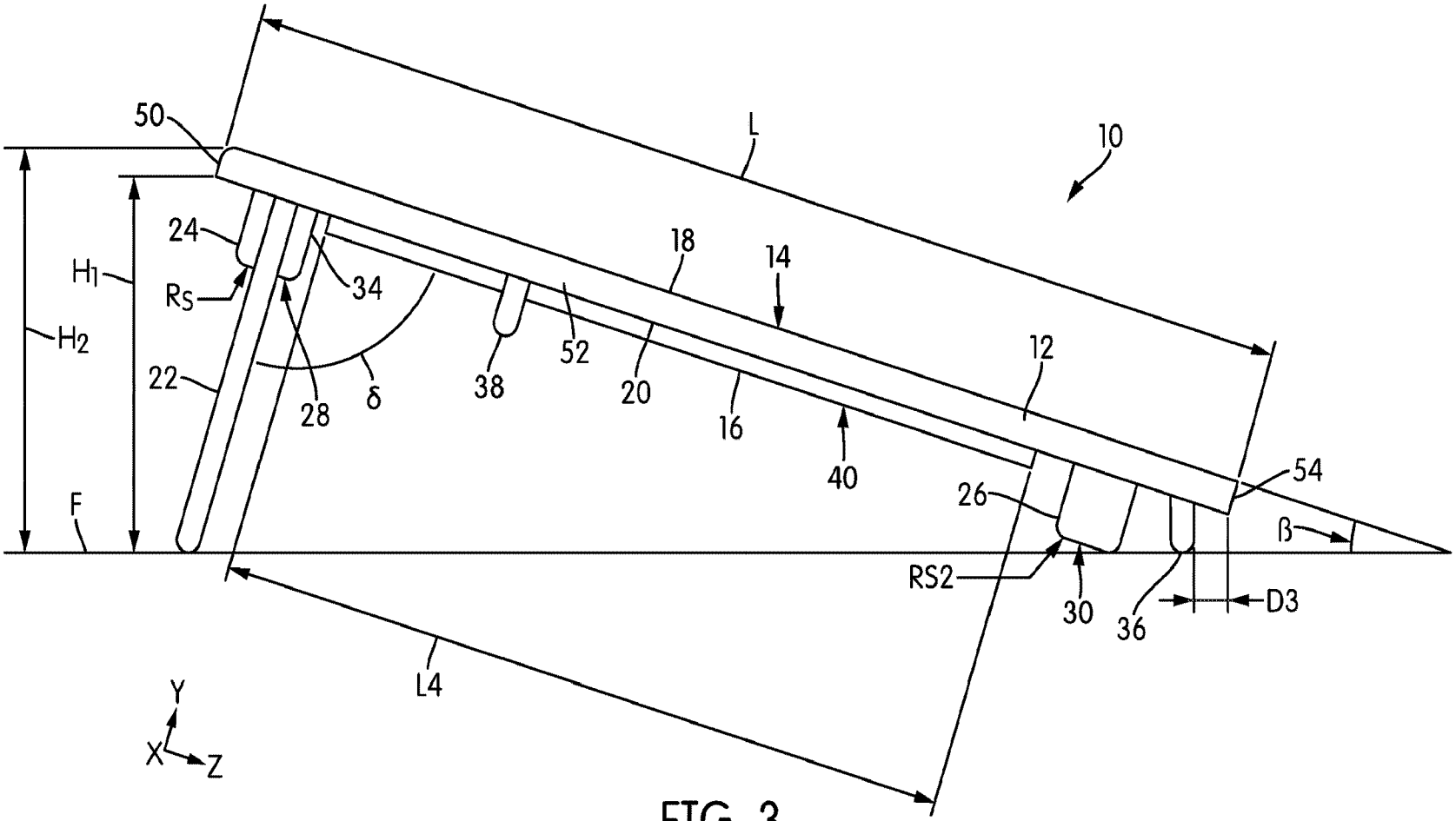

One or more pieces of tubing or tubes 40, as shown in FIGS. 3 and 5, may be mounted in a longitudinal direction on the opposite surface 20 of the exercise board 12 for rigidity and support. As seen in FIG. 5, two parallel tubes 40 may be mounted on the opposite surface 20 and extend longitudinally between the first end and the second end of the exercise board 12. The tubes 40 may be positioned such that there is a distance D therebetween. In an embodiment, the distance D between the tubes 40 is between approximately 7 inches and approximately 15 inches (both inclusive). In another embodiment, the distance D between the tubes 40 is between approximately 9 inches and approximately 13 inches (both inclusive). In one embodiment, the distance D is approximately 11 inches. The tubing 40 may be square or rectangular in shape, for example. The tubes may each have a length L4. In an embodiment, the length L4 of each tube is between approximately 36 inches and approximately 75 inches (both inclusive). In another embodiment, the length L4 of each tube is between approximately 48 inches and approximately 60 inches (both inclusive). In one embodiment, the length L4 is approximately 56.5 inches.

Figure 34:
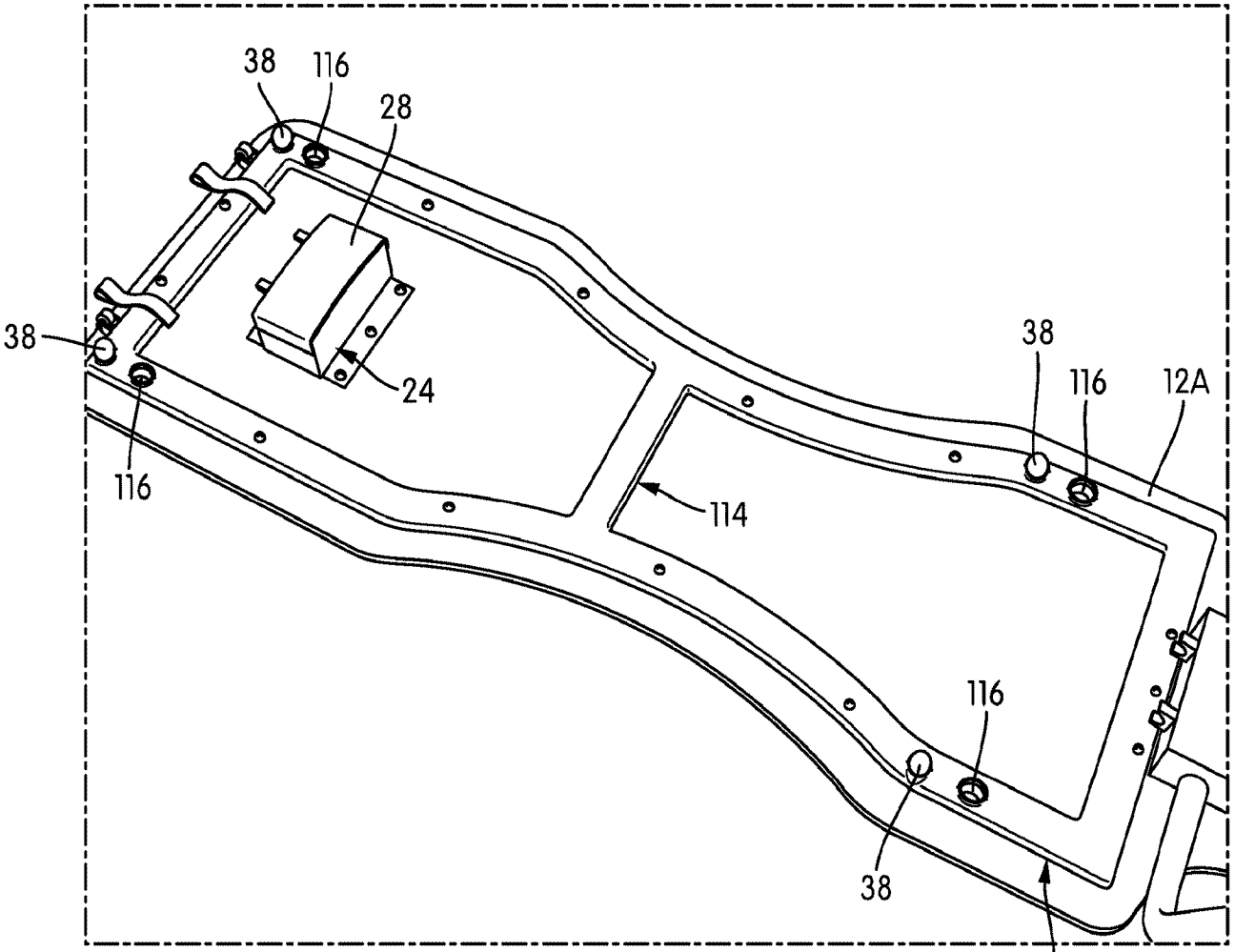
FIG. 34 is a bottom view of an exercise board assembly with a frame attached thereto in accordance with an embodiment of this disclosure.

In one embodiment, a frame 112 is mounted on the exercise board 12 for rigidity or support. The frame 112 may be provided as an alternative to, or in addition to, one or more tubes 40. FIG. 34 shows an example of an underside or opposite side 20 of one embodiment of an exercise board 12A (see FIGS. 14-26) having a frame 112 that is mounted thereon and positioned near a perimeter of the board 12. The frame 112 may be positioned along a peripheral edge, or spaced a distance from the peripheral edge. The frame 112 may have a similar shape as the peripheral edge of the board 12, such as shown in FIG. 34, or have a different (e.g., polygonal, rectangular) shape than the board. One or more lateral cross bars 114 or frame pieces may also be provided for added lateral strength and rigidity. The frame 112 may be formed from any number of materials, such as metal or plastic. The frame 112 may be mounted to the board in any number of ways, including, but not limited to, using bolts and/or adhesive.

Figure 35:
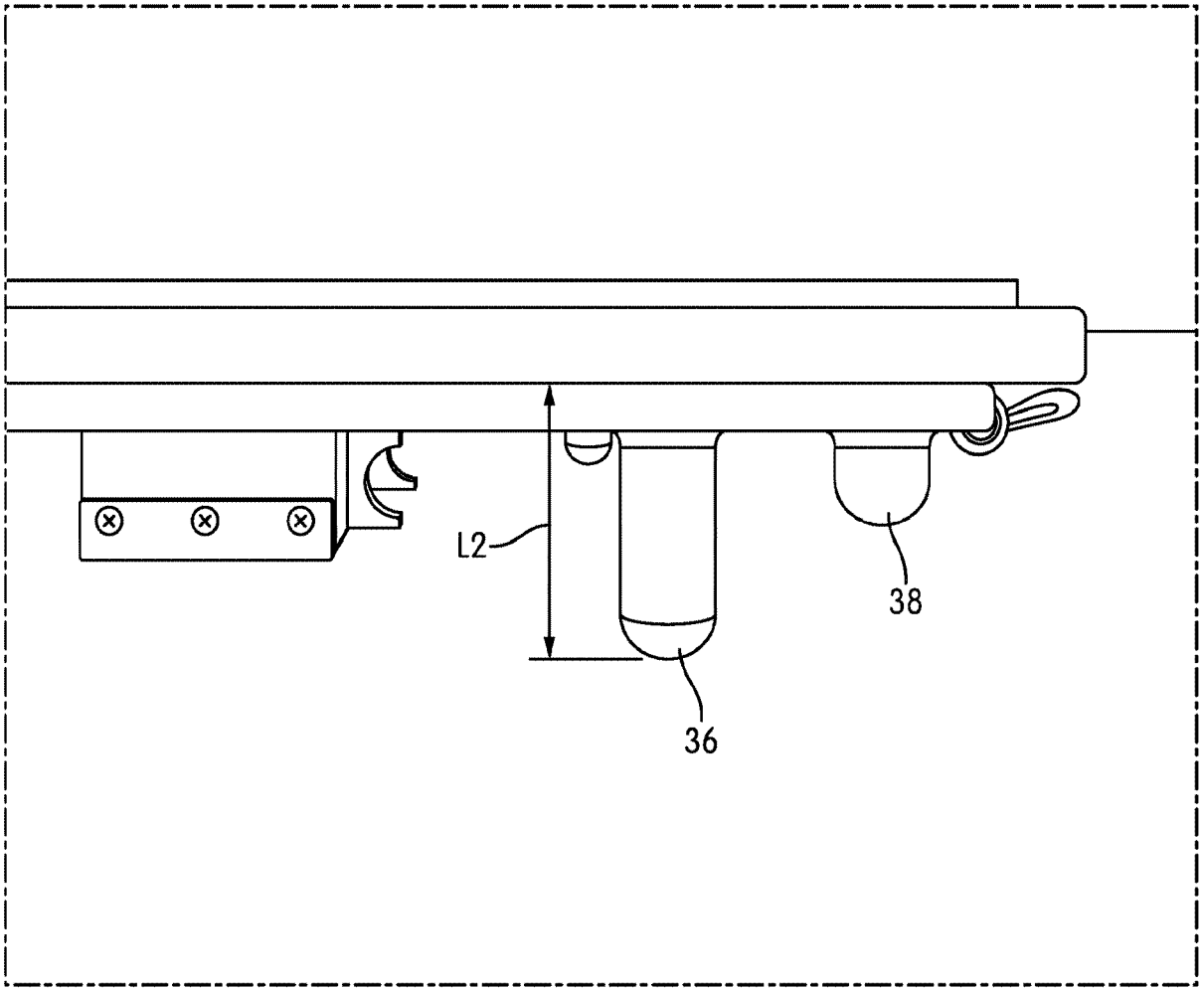
FIG. 35 is a detailed view of an end of an exercise board in accordance with an embodiment showing a foot and stop extending from an underside.

In an embodiment, any number of legs or feet 36 may be provided with or on the board 12. The feet 36 may be mounted to extend from the opposite side 20 of the board 12. The feet 36 may be used to provide stability to the board 12 depending upon its position (e.g., in a flat or folded position, described further below, the feet may be used to keep the board 12 from rocking). Any number of legs or feet 36 may be provided with board 12. For example, as shown in greater detail in FIG. 4, at or near the flat edge 54 at the second (bottom) end of the exercise board assembly are two feet 36 (e.g., see FIG. 8) that are part of the assembly 10. The feet 36 have a distance D2 therebetween (FIG. 8). In an embodiment, the distance D2 between the feet 36 is between approximately 15 inches and approximately 20 inches (both inclusive). In another embodiment, the distance D2 between the feet 36 is between approximately 16½ inches and approximately 18½ inches (both inclusive). In one embodiment, the distance D2 is approximately 17¼ inches. The feet 36 are also positioned inwardly such that a clearance D3 from the bottom edge 54 on the second side 16 to each foot 36 (see FIG. 3) is provided around the underside edge of the exercise board 12, to allow for placement of a user's fingers when holding onto the board 12 during exercise. In an embodiment, the distance D3 is between approximately 1 inch and approximately 4 inches (both inclusive). In another embodiment, the distance D3 is between approximately 2 inches and approximately 3 inches (both inclusive). In one embodiment, the distance D3 is approximately 2½ inches. The feet 36 may also be positioned to extend at an acute angle $\alpha$ from the second side 16, in one embodiment. In an embodiment, the angle $\alpha$ is between approximately 10 degrees and approximately 20 degrees (both inclusive). In another embodiment, the angle $\alpha$ is between approximately 12 degrees and approximately 18 degrees (both inclusive). In one embodiment, the angle $\alpha$ is approximately 15 degrees. As viewed from a bottom side, the feet 36 may extend at an obtuse angle (not shown) from the second side 16 relative to a longitudinal centerline of the exercise board 12. In yet another embodiment, the feet 36 may be positioned perpendicularly relative to surface of the board 12, such as shown in FIG. 35. In an embodiment, the feet 36 extend a length L2 that is measured from the opposite side 20 of the exercise board 12 to a bottom (e.g., see FIG. 7). In one embodiment, the length L2 is between approximately 1 inch and approximately 4 inches (both inclusive). In another embodiment, the length L2 of each foot 36 is approximately 3¼ inches (see, e.g., FIG. In another embodiment, the length L2 of each foot 36 is approximately 2 inches. In one embodiment, the feet 26 may have a diameter of between approximately 1 inch and approximately 2 inches. In one embodiment, the feet 26 may have a diameter of approximately 1½ inches. In another embodiment, the feet 26 may have a diameter of approximately 1¼ inches. The feet 36 may be formed of molded rubber, TPE, or other non-slip material(s), for example.

Figure 36:
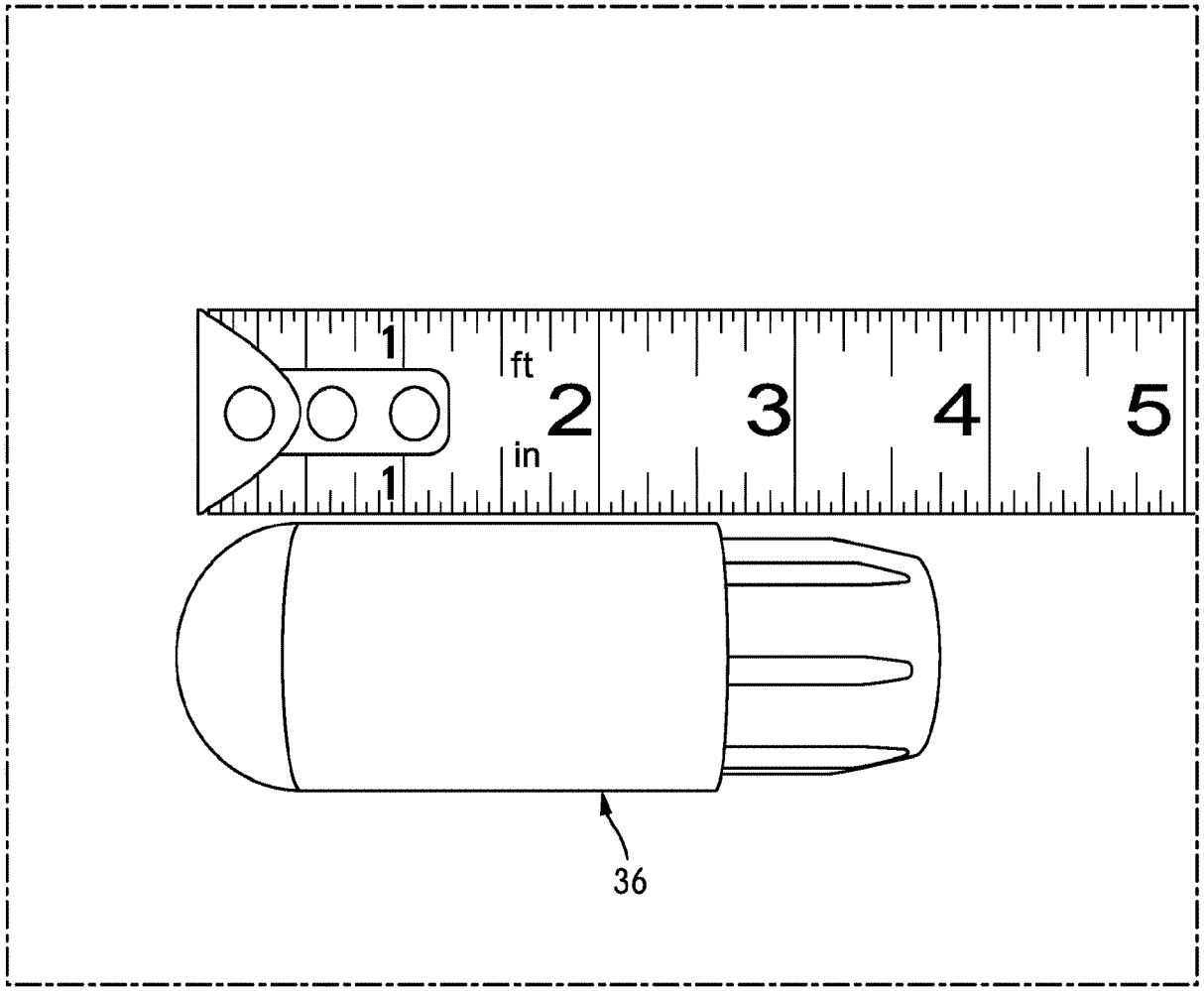
FIG. 36 is a detailed view of a removable foot for use with the exercise board assembly in accordance with an embodiment.
Figure 37:
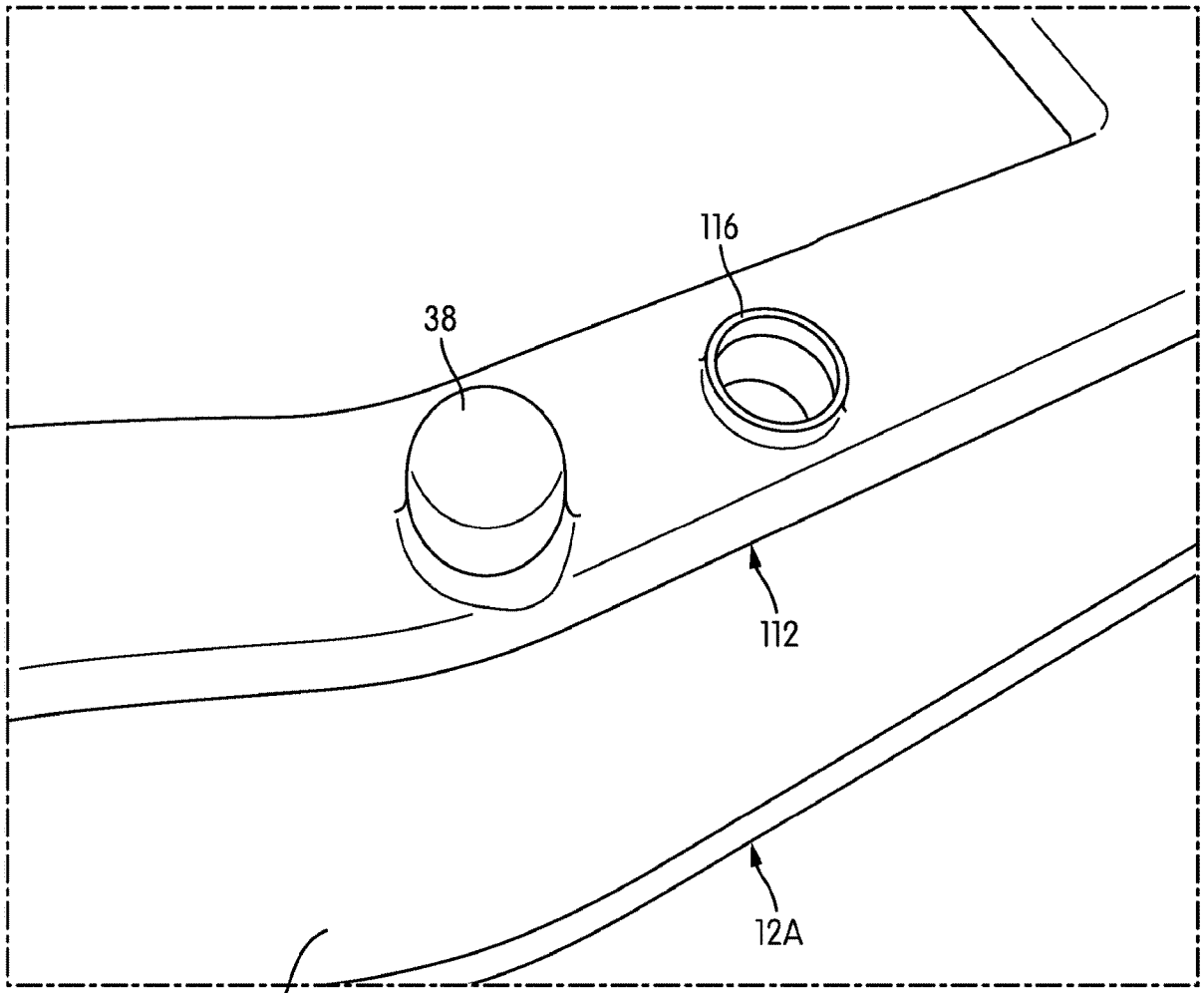
FIG. 37 is a detailed view of part of the frame of FIG. 34 with a hole therein.
Figure 38:
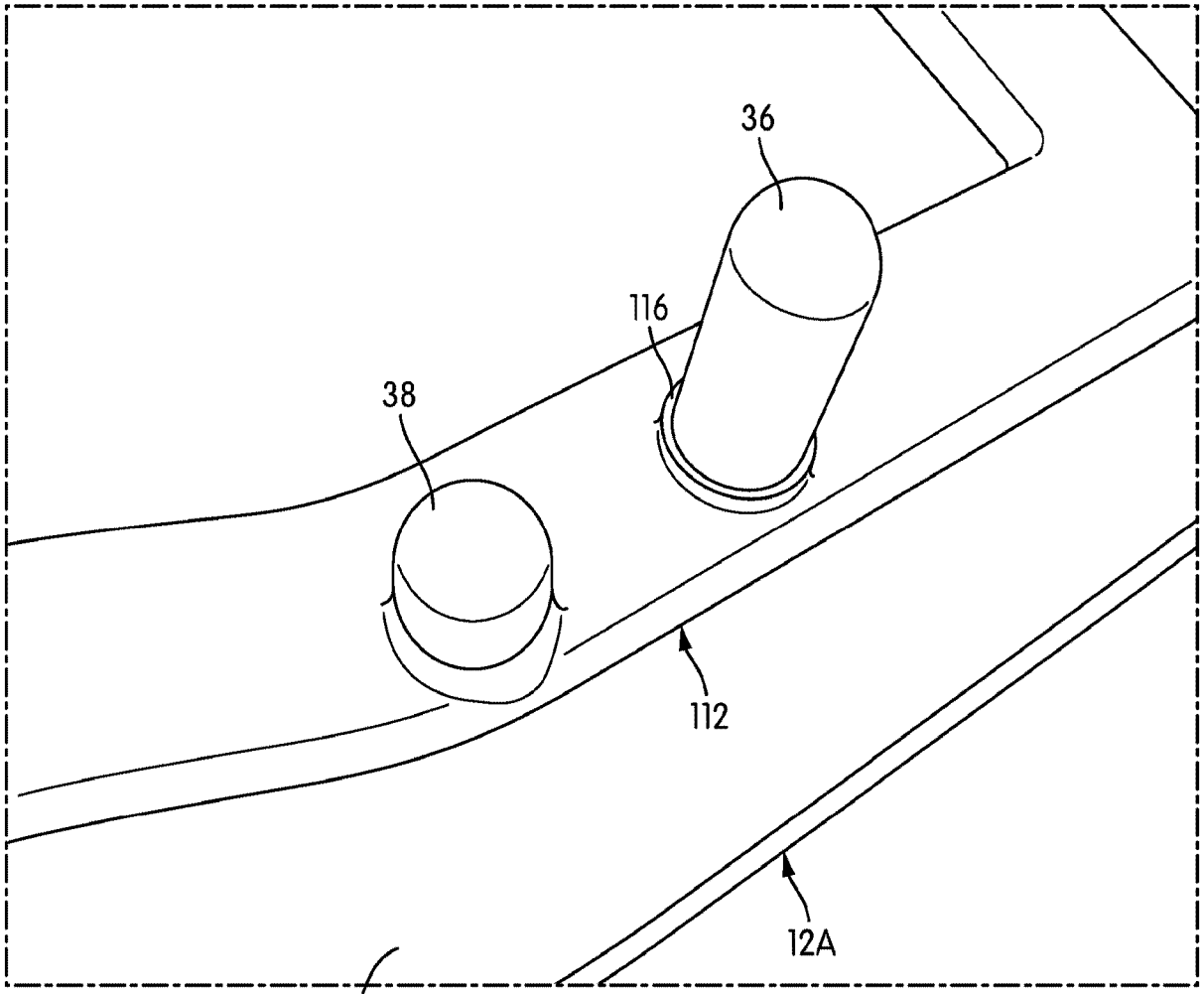
FIG. 38 is a detailed view of part of the frame of FIG. 37 with the removable foot of FIG. 36 positioned within the hole.

In accordance with an embodiment, one or more of the legs or feet 36 may be removable. For example, feet 36 may be removably attached to the board 12. In one embodiment, the opposite side 20 of the board 12 is designed for receipt of removable feet 36. For example, the feet 36 may include a portion of similar or smaller diameter, such as shown in FIG. 36, that is designed for insertion into a receiving opening or hole for mounting each foot 36. As seen in FIG. 34 and in greater detail in FIG. 37, mounting holes 116 may be provided in different locations along the frame 112, for example. Alternatively, mounting holes 116 may be a separate receiving piece that is separately mounted to the opposite side 20 of the board 12, or the holes 116 may be formed within the board 12 (12A, 12B) itself. FIG. 38 illustrates an example of a foot 36 mounted and secured within one of the mounting holes 116 of the frame 112.

Figure 39:
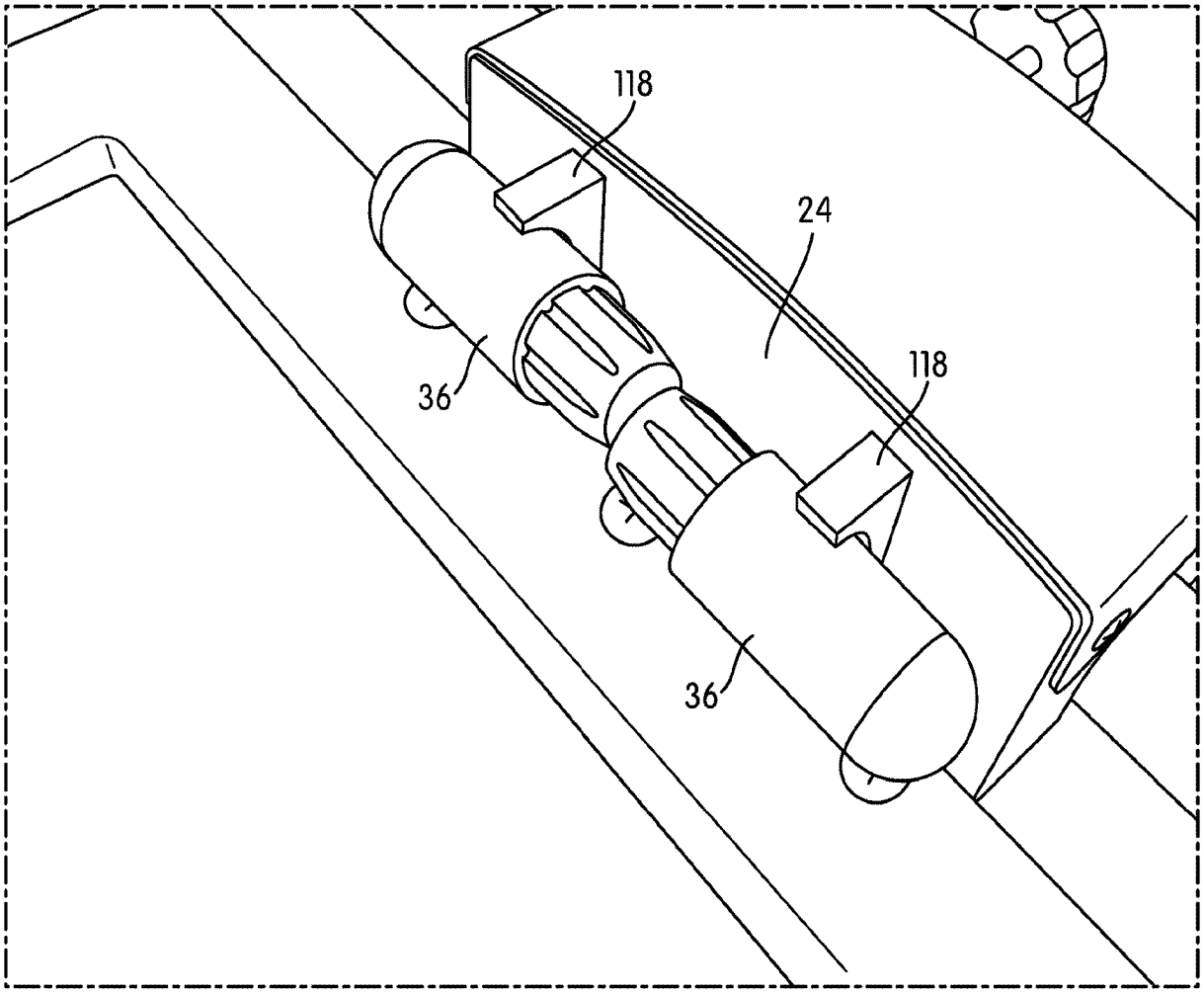
FIG. 39 is a detailed view of storage clips on a rocker for storing removable feet of the exercise board assembly in accordance with an embodiment.

If the feet 36 are removed from their mounted position in the exercise board 12 (or 12A, 12B), they may be stored with the assembly 10. FIG. 39 illustrates one example of storage clips 118 being provided on rocker block 24. The storage clips 118 may have a clamping or "C" shaped configuration that is configured to receive and wrap around part of a body of each foot 36 to hold it securely therein, for example. In an embodiment, the feet 36 may be snap-fit into the storage clips 118. Clips 118 may also be provided on other parts of the assembly, including, but not limited to, the opposite side 20, the frame 112, tubes 40, the support leg 22, or other rocker blocks (e.g., block 26).

In one embodiment, the length of the feet 36 attached to the board 12 may be selected based on the position of the board 12. In an embodiment, different lengths of feet 36 may be used with or along the exercise board 12.

The support leg 22 is pivotally mounted to the exercise board 12. As shown in FIGS. 3 and 5, for example, the support leg 22 may be mounted to the exercise board 12 on the second side 16 and adjacent to or near the rounded top edge 50 at the first (top) end of the board 12. The support leg 22 is constructed and arranged to be secured in multiple positions relative to the exercise board 12, such those generally represented in FIGS. 6 and 7 (described in greater detail later). As best seen in FIG. 5, the support leg 22 has a substantially trapezoidal shape. The support leg 22 includes parallel sides in the form of a top portion 60 and a bottom portion 62, and angled side portions 64 between the top portion 60 and bottom portion 62. The angled side portions 64 may be positioned at an angle Θ relative to the bottom portion 62. For example, in accordance with an embodiment, the angle Θ is between approximately 70 degrees and approximately 75 degrees. In one embodiment, the angle Θ is approximately 71 degrees. The top portion 60 has a length that is smaller than the bottom portion 62. In an embodiment, the overall width W2 of the bottom portion 62 of the support leg 22 extends between approximately 25 inches to approximately 35 inches. In one embodiment, the width W2 of the bottom portion 62 is approximately 33 inches. In another embodiment, the width W2 of the bottom portion 62 is approximately 26-27 inches. The edges of the support leg 22 may be rounded and formed from a tube or a bar that is bent or molded, for example. In one embodiment, the support leg 22 is formed from 1.5 inch diameter tubing. The support leg 22 may have curved portions of radius R1 transitioning from the top portion 60 into the angled side portions 64. The support leg 22 may also include bottom curved portions of radius R2 between the angled side portions 64 and bottom portion 62. In an embodiment, R2>R1. In one embodiment, R1 is approximately 2.75 inches. In an embodiment, R2 is approximately 4 inches.

The assembly 10 also has a rocker block 24 with a rocker surface 28 thereon that is used to support the exercise board 12 on the floor surface F when the support leg 22 is in one or more positions away from contact with the floor. The rocker block 24 is attached to the opposite surface 20 of the exercise board 12 (e.g., see FIG. 3). The rocker block 24 may be centered relative to a centerline extending longitudinally through the exercise board 12. The rocker surface 28 is engageable with the floor surface F to cause the user support surface 18 to be unstable on the floor surface F when supporting a user. The rocker surface 28 may include a radius of curvature Rs for providing a curved surface which contacts and engages the floor surface F. The radius of curvature Rs of the rocker surface 28 may be within a range of approximately 16 inches and approximately 24 inches (both inclusive) in accordance with an embodiment. In another embodiment, the radius of curvature Rs of the rocker surface 28 may be within a range of approximately 18 inches and approximately 22 inches (both inclusive). In one embodiment, the radius of curvature Rs for the rocker block 24 is approximately 20 inches.

Figure 9:
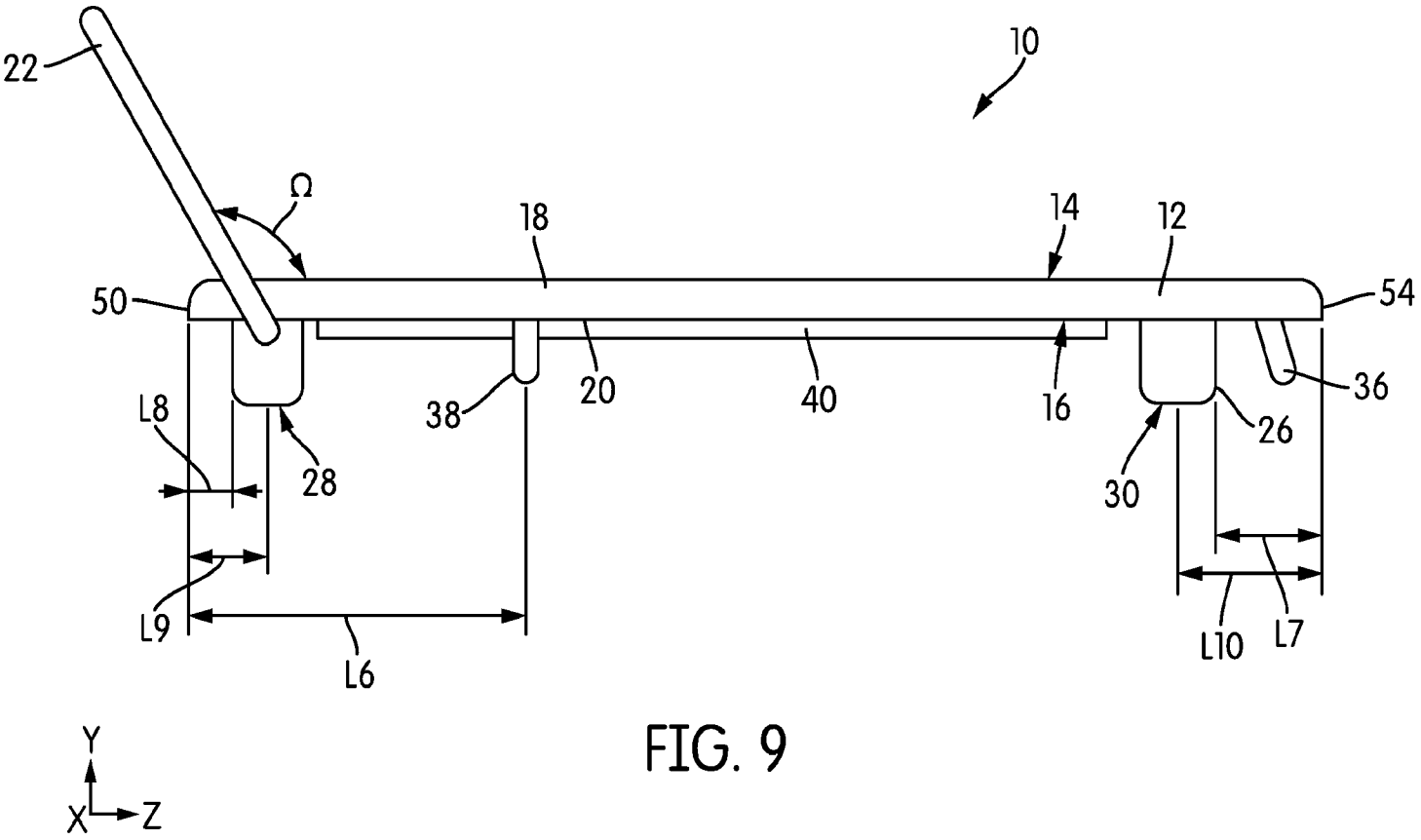

The rocker block 24 may be positioned a length L8 from the first (top) end of the exercise board 12. As shown in FIG. 9, length L8 may be measured from the outer edge at the first end of the board 12 to a top outer surface of the rocker block 24. The length L8 from the outer (top) edge and the outer surface of the rocker block 24 may be within a range of approximately 1 inch and approximately 8 inches (both inclusive) in accordance with an embodiment. In another embodiment, the length L8 may be within a range of approximately 2 inches and approximately 6 inches (both inclusive). In yet another embodiment, the length L8 is approximately 3 inches.

In another embodiment, the rocker block 24 may be positioned a length L9 from the first (top) end of the exercise board 12. As shown in FIG. 9, length L9 may be measured from the outer edge at the first end of the board 12 to a center of the rocker block 24. The length L9 from the outer (top) edge and the center of the rocker block 24 may be within a range of approximately 3 inches and approximately 9 inches (both inclusive) in accordance with an embodiment. In another embodiment, the length L9 may be within a range of approximately 4 inches and approximately 7 inches (both inclusive). In yet another embodiment, the length L9 is approximately 5 inches.

In an embodiment, the support leg 22 has a portion thereof pivotally supported by the rocker block 24. In one embodiment, the top portion 60 of the support leg 22 extends through openings 34 in the rocker block 24.

In one embodiment, a second rocker block 26 with a second rocker surface 30 disposed thereon is included on the exercise board 12. The rocker block 26 is attached to the opposite surface 20 of the exercise board 12. The rocker block 24 and the second rocker block 26 are spaced from one another on the board 12. In an embodiment, the rocker block 24 is provided adjacent a first (top) end of the board 12 and the second rocker block 26 is provided at a second (bottom) end of the board 12. The second rocker block 26 and its rocker surface 30 may also be used to support the exercise board 12 on the floor surface F when the support leg 22 is in one or more positions away from contact with the floor.

The second rocker block 26 may be centered relative to a centerline extending longitudinally through the exercise board 12. The second rocker surface 30 is curved and engageable with the floor surface F to cause the user support surface 18 to be unstable for a user supported thereby or thereon, thus causing it to rock or tilt relative to the floor. The radius of curvature Rs2 of the rocker surface 28 may be the same as or similar to the radius of curvature Rs2 of the rocker surface 28. The radius of curvature Rs2 of the rocker surface 30 may be within a range of approximately 16 inches and approximately 24 inches (both inclusive) in accordance with an embodiment. In another embodiment, the radius of curvature Rs2 of the rocker surface 30 may be within a range of approximately 18 inches and approximately 22 inches (both inclusive). In yet another embodiment, the radius of curvature Rs2 for the rocker block 26 is approximately 20 inches.

The second rocker block 26 may be positioned a length L7 from the second (bottom) end of the exercise board 12. As shown in FIG. 9, length L7 may be measured from the outer edge at the second end of the board 12 to an outer surface of the rocker block 26. The length L7 from the outer (bottom) edge and the outer surface of the rocker block 26 may be within a range of approximately 3 inches and approximately 8 inches (both inclusive) in accordance with an embodiment. In another embodiment, the length L7 may be within a range of approximately 4 inches and approximately 7 inches (both inclusive). In yet another embodiment, the length L7 is approximately 6¼ inches.

In another embodiment, the second rocker block 26 may be positioned a length L10 from the second (bottom) end of the exercise board 12. As shown in FIG. 9, length L10 may be measured from the outer edge at the second end of the board 12 to a center of the rocker block 26. The length L10 from the outer (bottom) edge and the center of the rocker block 26 may be within a range of approximately 4 inches and approximately 12 inches (both inclusive) in accordance with an embodiment. In another embodiment, the length L10 may be within a range of approximately 6 inches and approximately 10 inches (both inclusive). In yet another embodiment, the length L10 is approximately 8 inches.

Figure 4:
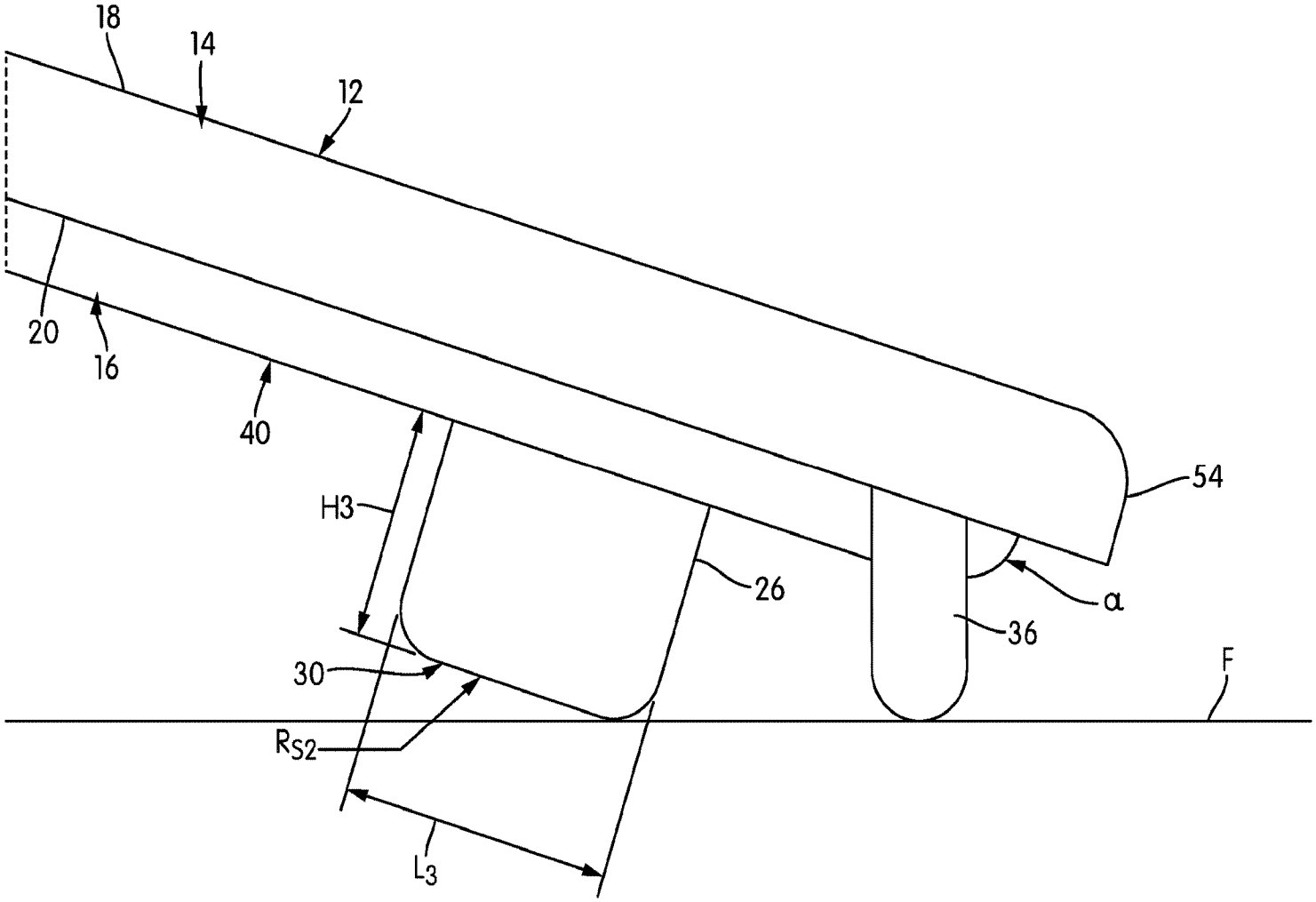
FIG. 4 is a detailed, bottom end view of the exercise board assembly of FIG. 1.

Further, as noted in FIGS. 4 and 5, each of the rocker blocks 24, 26 has a length L3, a width W3, and a height H3. In an embodiment, and as illustrated herein, the rocker blocks 24, 26 have similar dimensions. However, in accordance with another embodiment, the rocker blocks 24, 26 have one or more different dimensions. In an embodiment, the length L3 of each of the rocker blocks 24, 26 is between approximately 3 inches and approximately 6 inches. In another embodiment, the length L3 of each of the rocker blocks 24, 26 is between approximately 4 inches and approximately 5 inches. In one embodiment, the length L3 is approximately 4.3 inches. In an embodiment, the width W3 of each of the rocker blocks 24, 26 is between approximately 6 inches and approximately 10 inches. In another embodiment, the width W3 of each of the rocker blocks 24, 26 is between approximately 7 inches and approximately 8 inches. In one embodiment, the width W3 is approximately 7⅞ inches. In an embodiment, the height H3 of each of the rocker blocks 24, 26 is between approximately 3 inches and approximately 6 inches. In another embodiment, the height H3 of each of the rocker blocks 24, 26 is between approximately 4 inches and approximately 5 inches. In one embodiment, the height H3 is approximately 4½ inches.

An exemplary first position for the support leg 22 is illustrated in FIGS. 1-5, with the support leg 22 in a deployed, downwardly extended position. In this first position, the support leg 22 is positioned below the second side 16 of the board 12 and arranged to support the exercise board 12 in a stable angled or inclined configuration with respect to a floor surface F, as seen in FIG. 3, for example. In an embodiment, an angle δ between the support leg 22 and the opposite surface 20 is between approximately 60 degrees and approximately 120 degrees (both inclusive). In another embodiment, an angle δ between the support leg 22 and the opposite surface 20 is between approximately 75 degrees and approximately 105 degrees (both inclusive). In one embodiment, an angle δ between the support leg 22 and the opposite surface 20 is approximately 90 degrees.

Also shown in FIG. 3, when the assembly 10 is provided in the first position such that the support leg 22 and feet 36 are in contact with the floor surface F, the user support surface 18 is provided at an angle β relative to the floor. In one embodiment, the angle β for positioning support surface 18 is between approximately 10 degrees and approximately 30 degrees (both inclusive). In another embodiment, the angle β for positioning support surface 18 is between approximately 15 degrees and approximately 20 degrees (both inclusive). In yet another embodiment, the angle β is approximately 17 degrees. The opposite surface 20 is positioned at a height H1 from the floor surface F, and the user support surface is positioned at a height H2 from the floor surface F. In an embodiment, the height H1 is between approximately 10 inches and approximately 30 inches. In another embodiment, the height H1 is between approximately 15 inches and approximately 25 inches. In yet another embodiment, the height H1 is between approximately 20 inches and approximately 22 inches. In one embodiment, the height H1 is approximately 21¼ inches. In an embodiment, the height H2 is between approximately 10 inches and approximately 30 inches. In another embodiment, the height H2 is between approximately 15 inches and approximately 25 inches. In yet another embodiment, the height H2 is between approximately 18 inches and approximately 24 inches. In one embodiment, the height H2 is approximately 23 inches.

In some cases, the support leg 22 may be grasped or engaged by the arms, hands, legs, or feet of a user below the support surface 18 when performing exercises. Further, the rocker surfaces 28, 30 are out of contact with the floor surface F. FIG. 4 illustrates the second rocker block 26 and one of the feet 36 at the second (bottom) end of the board 12 in greater detail. The feet 36 engage the floor surface F when the support leg 22 is in this position. The feet 36 are also designed with a length L2 such that there is minimal clearance between the floor surface F and the rocker surface 30 of the second rocker block 26 when the user support surface 18 is positioned at angle β and the support leg 22 is provided in its deployed, downwardly extending position.

An exemplary second position for the support leg 22 is illustrated in FIGS. 8 and 9. In this illustrated second position, the support leg 22 is provided and secured in a deployed, upwardly extending position, such that the support leg 22 extends above the user support surface 18, and rocker surfaces 28, 30 of the rocker blocks 24, 26 engage and contact the floor surface F. The user support surface 18 extends in a generally parallel configuration relative to the floor surface F. In this second, upwardly extending position, the support leg 22 is provided at an angle Ω relative to the user support surface 18 (e.g., see FIG. 9). In one embodiment, the angle Ω for the support leg 22 relative to the user support surface 18 is between approximately 45 degrees and approximately 75 degrees (both inclusive). In another embodiment, the angle Ω for the support leg 22 relative to the user support surface 18 is between approximately 55 degrees and approximately 65 degrees (both inclusive). In yet another embodiment, the angle Ω is approximately 60 degrees. Also in such a position, the support leg 22 may be grasped or engaged by the arms, hands, legs, or feet of a user above the support surface 18 while performing exercises.

Figure 10:
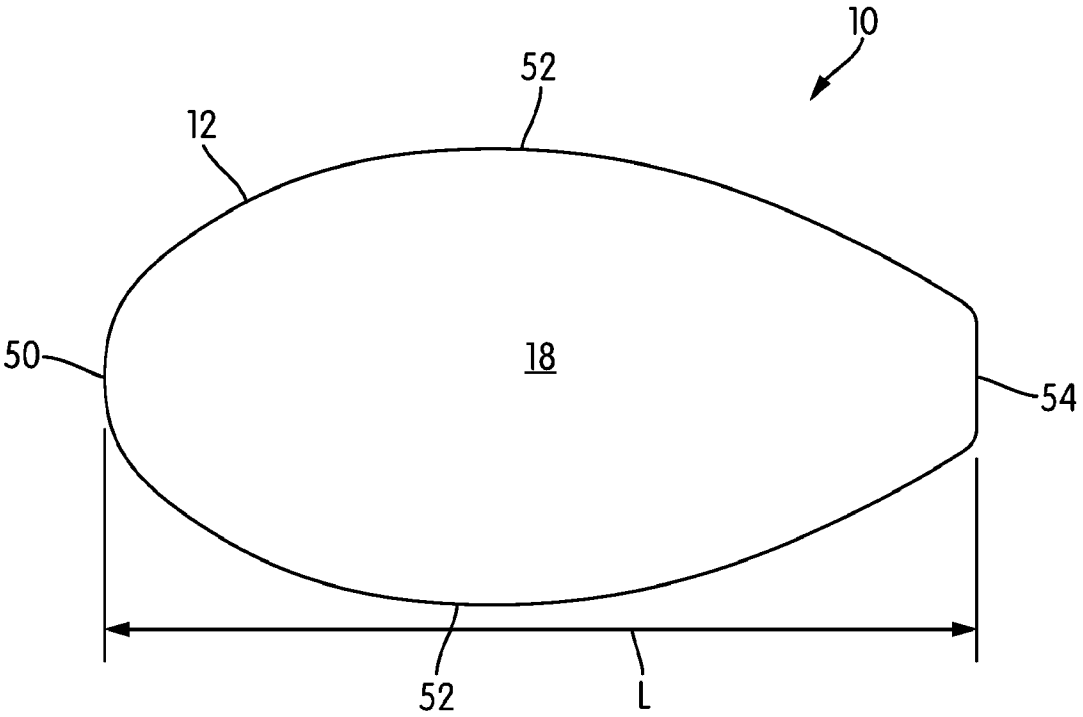
FIGS. 10-11 show a top view and a side view of the exercise board assembly of FIG. 1 with the support leg in a third position and a rocker surface in accordance with an embodiment of this disclosure.
Figure 11:
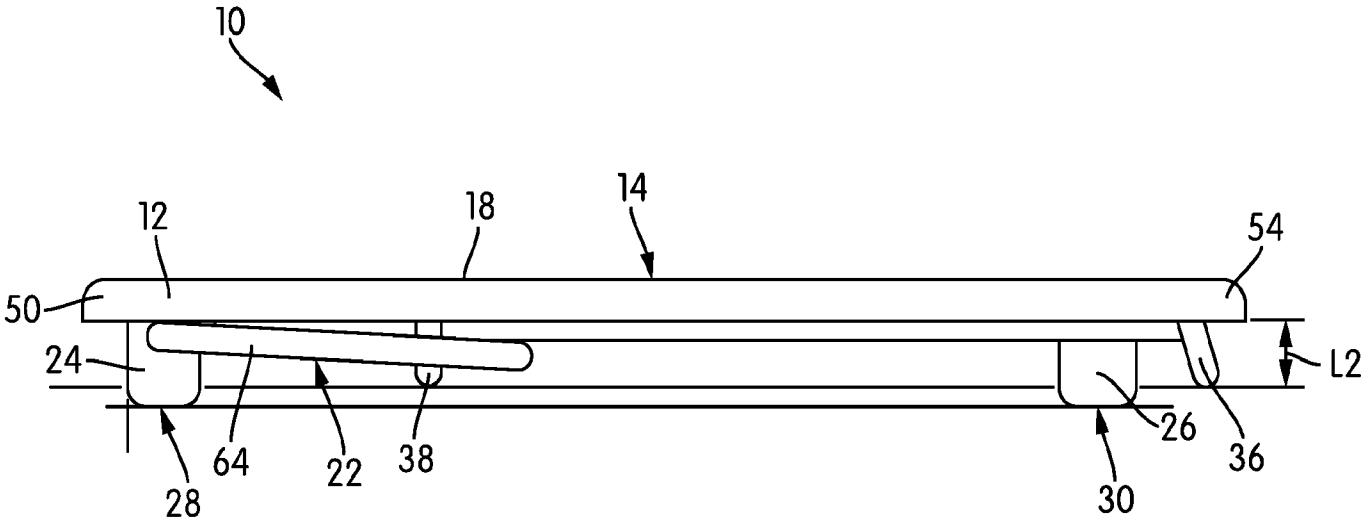

An exemplary third position for the support leg 22 is illustrated in FIGS. 10 and 11, for example. In this position, the support leg 22 is folded to extend generally alongside the opposite surface 20 of the board 12. The support leg 22 may be positioned such that the entire structure thereof is positioned closer to the opposite surface 20 than at least a portion of the rocker surface 28 (e.g., see FIG. 11). In an embodiment, the support leg 22 may be positioned in contact with the tubes 40 in this folded position. This provides a more compact configuration to the exercise board assembly 10 to facilitate storage thereof. In addition, as described with reference to FIGS. 12 and 13, when in this third or folded position, the exercise board 12 may be used to perform stability exercises when positioned on a floor surface F.

Figure 6:
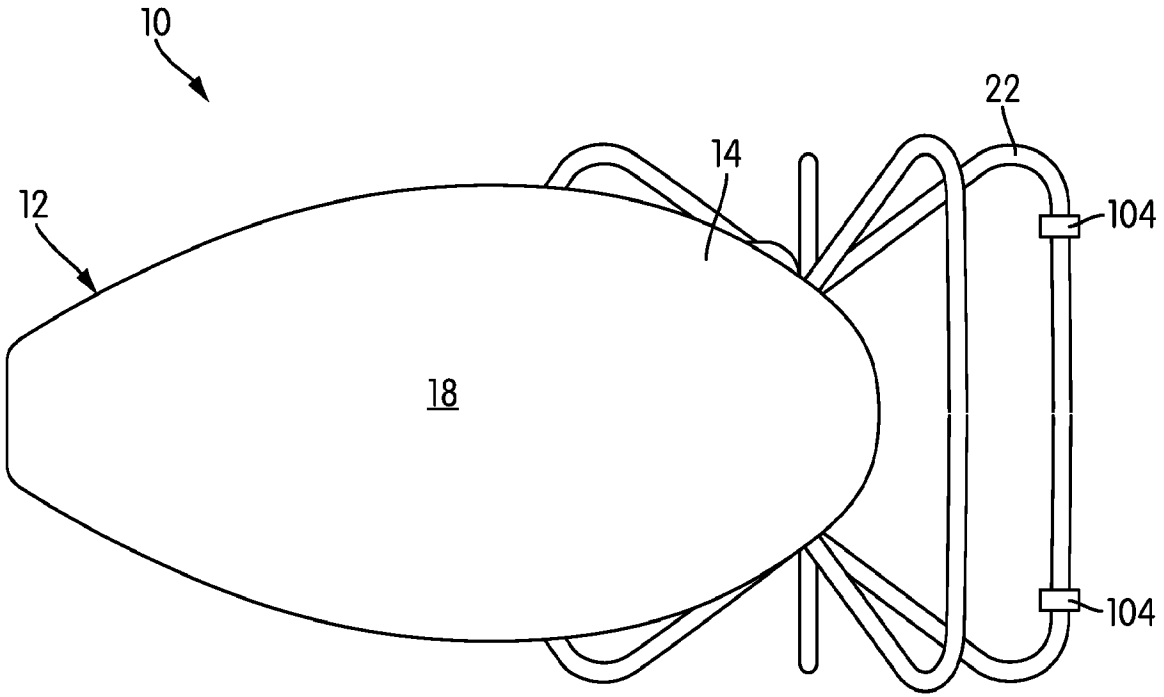
FIGS. 6-7 show different positions of the support leg relative to the exercise board in accordance with an embodiment of this disclosure.
Figure 7:
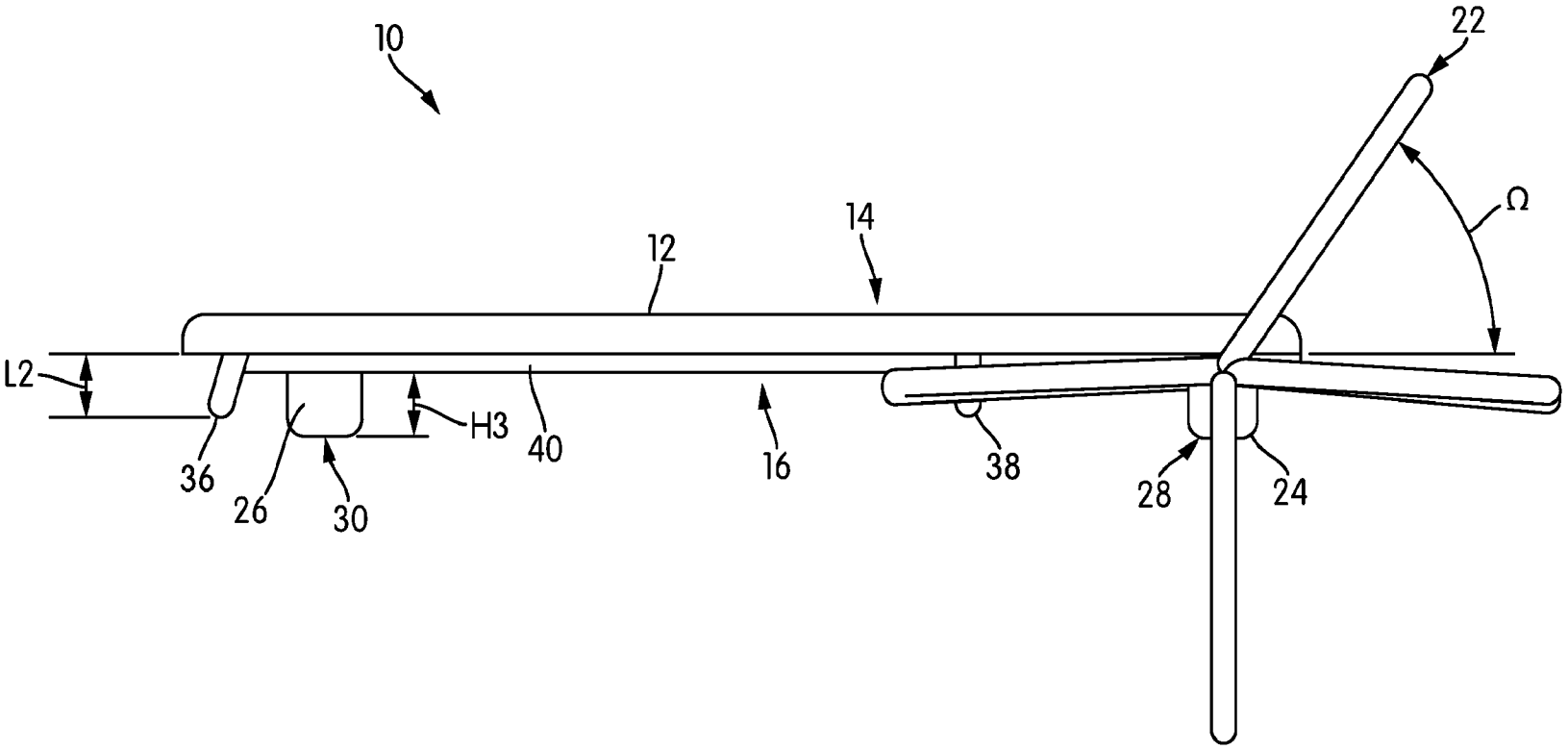
Figure 8:
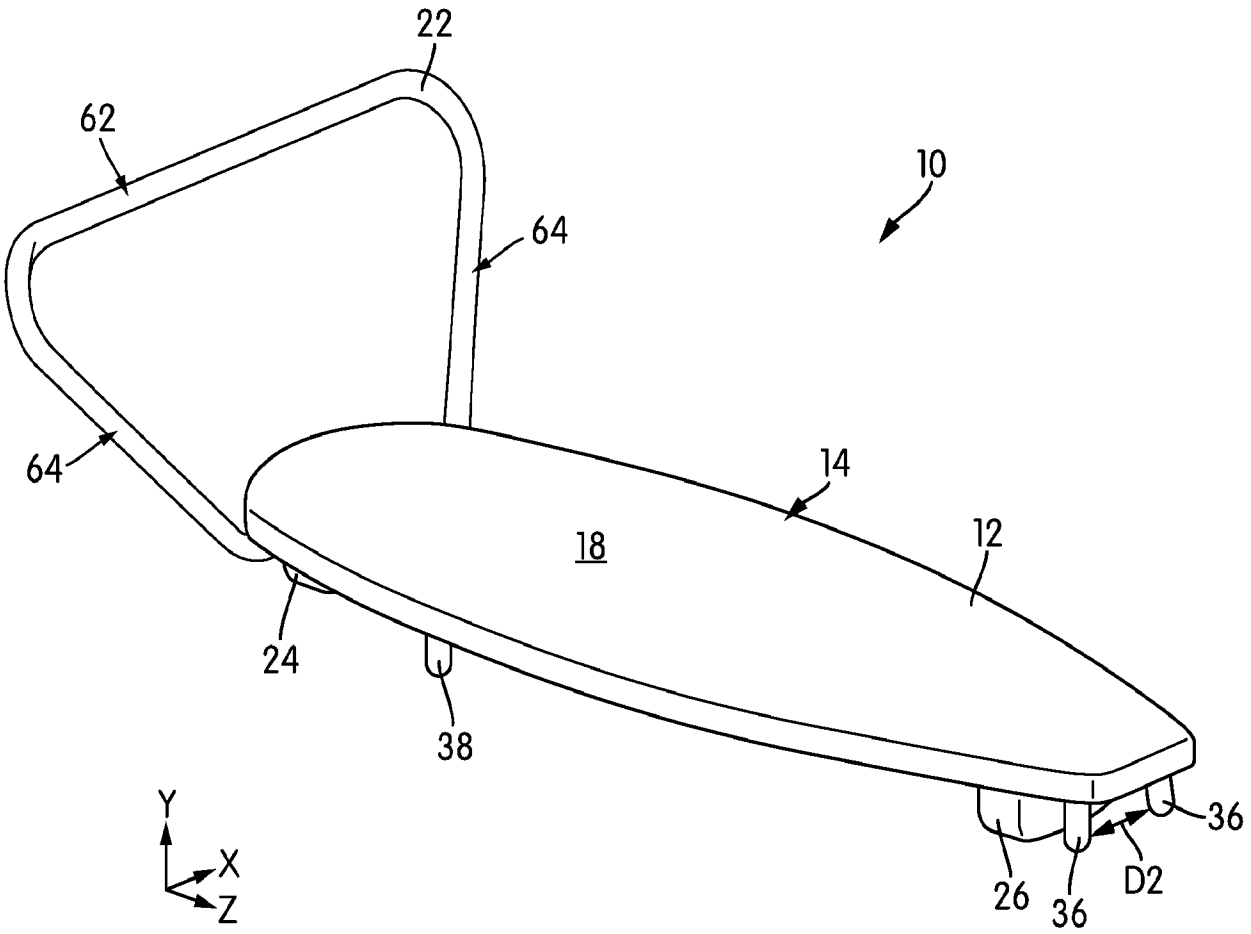
FIGS. 8-9 show an isometric view and a side view of the exercise board assembly of FIG. 1 with the support leg in a second position in accordance with an embodiment of this disclosure.

An exemplary fourth position for the support leg 22 is also shown in FIGS. 6 and 7. In the fourth position, for example, the support leg 22 may extend forwardly relative to the first (top) end of the exercise board 12 and away from the surfaces 18 and 20 thereof. In this position, the support leg 22 may be designed to prevent tilting or movement of the board via the rocker surfaces 28, 30.

In one embodiment, one or more feet 110 (e.g., see FIG. 6) may be provided on or around the support leg 22 (e.g., on a bottom portion 62) to reduce and/or prevent sliding or movement of the exercise board 12 when the support leg 22 is in contact with the floor, e.g., in the first position or the fourth position. The feet 110 may be formed of molded rubber, TPE, or other non-slip material(s), for example.

Other positions for the support leg 22 that are different from those illustrated may also be employed, and thus the illustrated configurations of the support leg 22 relative to the exercise board 12 are not intended to be limiting.

Figure 42:
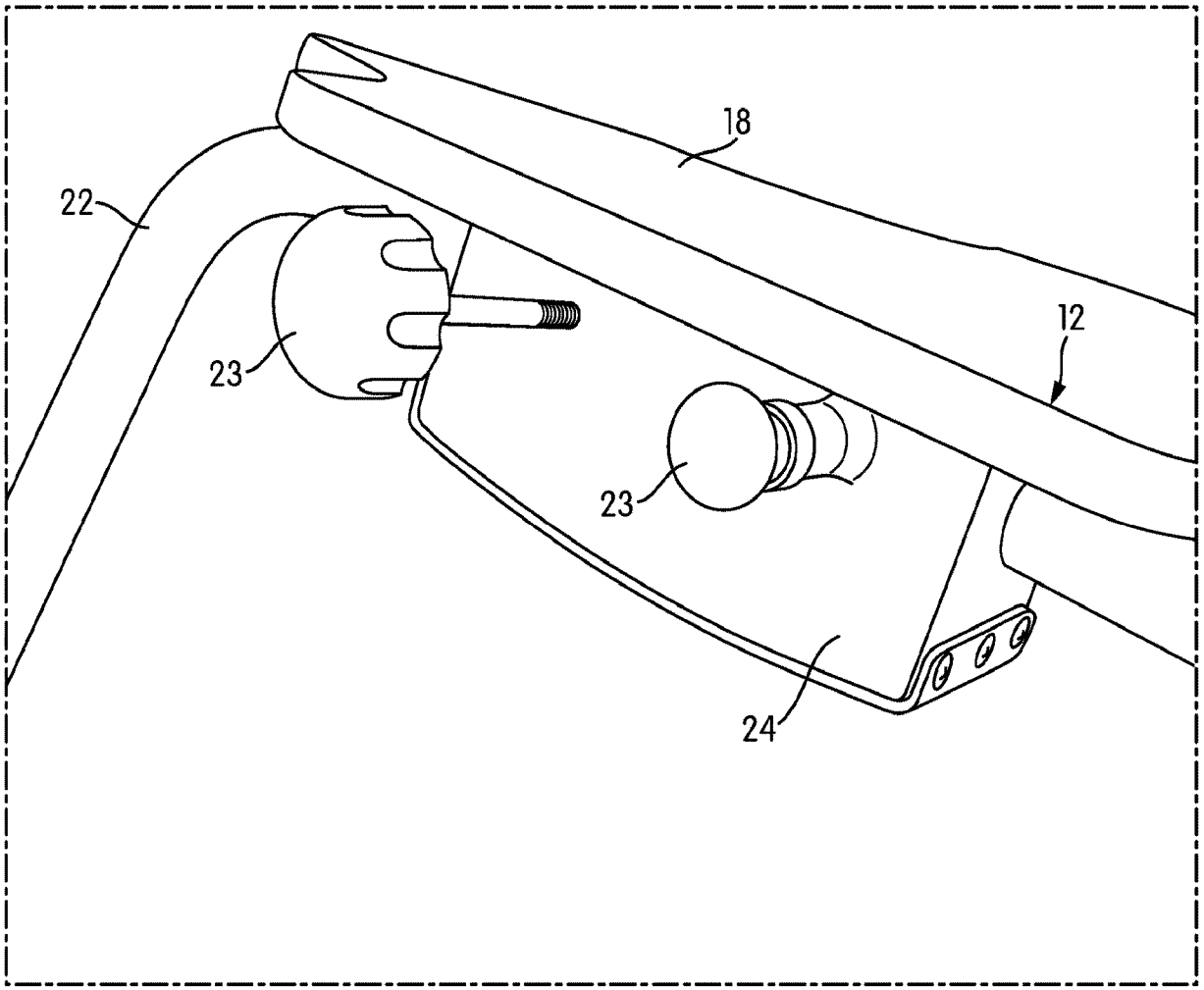
FIG. 42 is a detailed end view of a locking pin and locking knob that may be used to secure or lock a support leg of an exercise board assembly in its different positions, in accordance with an embodiment.

To secure or lock the support leg 22 in its positions, a locking pin 23 (shown in FIG. 42) may be provided. For example, the locking pin 23 may be configured for insertion into one or more positions through the support leg 22 and in engagement with a hole on rocker block 24. In another embodiment, a locking knob 25 (also shown in FIG. 42) may be used to secure the support leg 22 in any of its position. The locking knob 25 may be secured by frictional engagement with a surface such as a surface on the rocker block 24. In yet another embodiment, the support leg 22 may be designed to snap-lock into its multiple positions.

Figure 12:
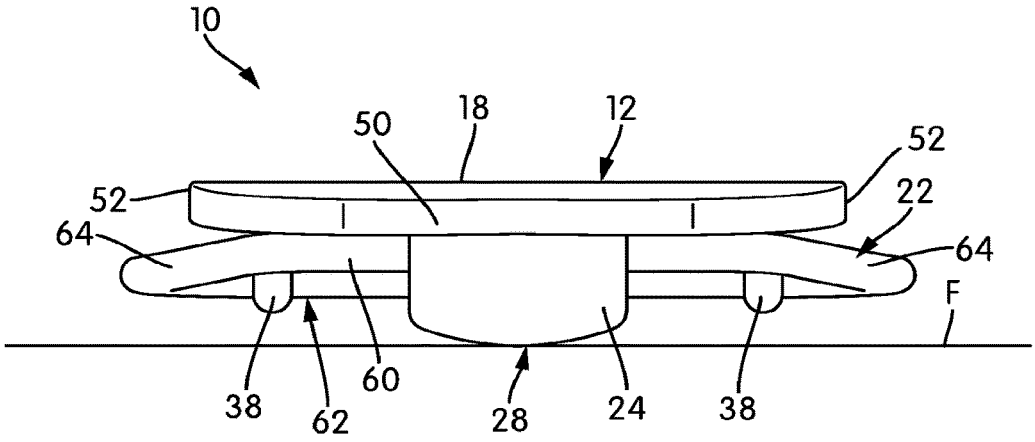
FIGS. 12-13 show a top end view of the exercise board assembly of FIG. 1 with the support leg in a third position and exemplary movement of the rocker surface relative to the floor surface in accordance with an embodiment of this disclosure.
Figure 13:
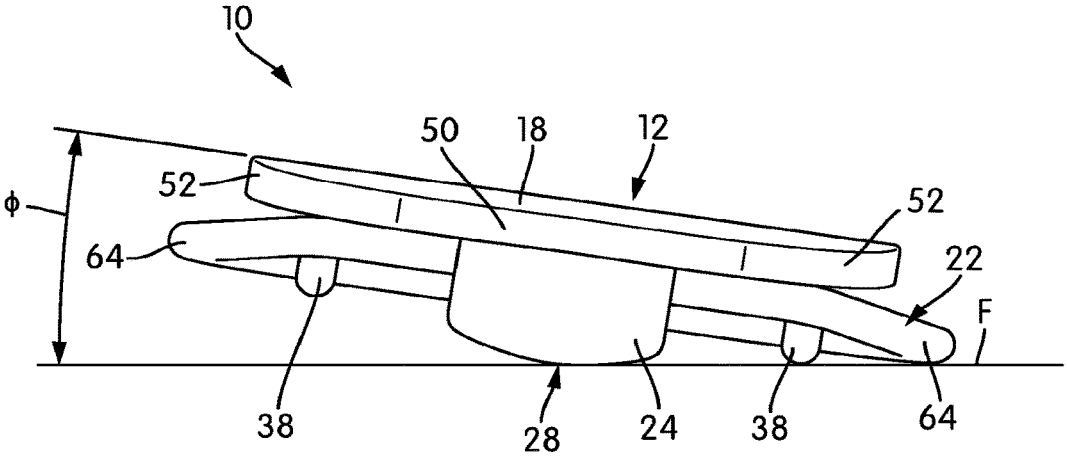

In any, some, or all of the second, third, or fourth positions shown in FIGS. 6-11, the rocker surfaces 28, 30 of the rocker blocks 24, 26 may be employed for use by a user to perform a number of exercises, including stability exercises, since the support leg 22 is positioned such that at least a portion of the rocker surfaces 24, 28 engage the floor surface F. For example, FIGS. 12-13 show a top end view of the exercise board assembly 10 with the support leg 22 in the third position as described with reference to FIGS. 10 and 11. Although only the rocker surface 28 is shown in this figure, it should be understood that both surfaces 24, 28 as provided on the floor surface F to support the exercise board 12 FIG. 12 shows positioning of the user support surface 18 of the exercise board 12 is a substantially parallel manner relative to the floor surface F. However, when an unbalanced weight, force, or pressure is provided on the user support surface 18 towards either side 52, the board 12 may rock via rocker surfaces 24, 28. As shown in FIG. 13, for example, the board 12 may tilt towards one side (e.g., towards the right) relative to the floor surface F when the weight on the board 12 is unbalanced. The depicted positions of the support leg 22 in FIGS. 6 and 7 further show how the rocker surfaces 28, 30 are also constructed and arranged to support the exercise board 12 on a floor surface F when the support leg is in the deployed, upwardly extended position (as shown in FIGS. 8 and 9) as well as in the fourth, forwardly extending position.

Figure 15:
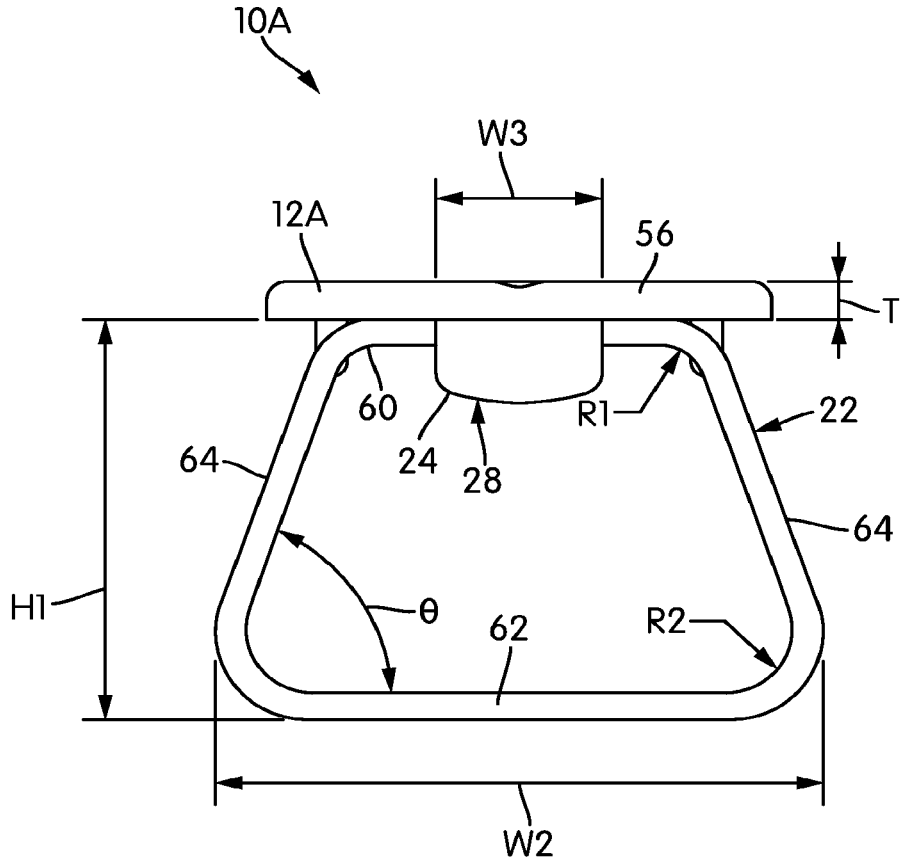

To limit an amount or a range of rocking movement of the exercise board 12 relative to the floor surface F, one or more stops 38 may be provided on the opposite side 20 of the exercise board 12. The stop(s) 38 may be formed in a similar manner to the feet 36, e.g., of a molded rubber (or TPE, or non-slip material(s)), and may be of similar design or shape (e.g., rounded and/or having a diameter), but the stop(s) 38 may be of a different (e.g., shorter) length as compared to the feet 36. Two stops 38 are shown in FIG. 15, for example, positioned adjacent each side 52 of the exercise board 12, and positioned outside of the tubes 40 (relative to a centerline of the exercise board 12) (see also FIG. 5). The stops 38 may be mounted to extend from the opposite side 20 of the board 12. The stops 38 are positioned to extend from the second side 16 (see FIG. 3) of the exercise board 12. The stops 38 are provided on the underside of the board 12 at a length L6 measured from the first (top) end to a center of the stops 38 (see FIG. 9). In one embodiment, the length L6 is between approximately 14 inches and approximately 24 inches (both inclusive). In another embodiment, the length L6 is between approximately 18 inches and approximately 22 inches (both inclusive). In one embodiment, the length L6 is approximately 20 inches. FIG. 35 shows an example of the relative positioning of a stop 38 and a foot 36 on the underside or opposite side 20 of the board 12.

The stops 38 may include a diameter. In one embodiment, the diameters of the stops 38 are between approximately 1 inch and approximately 4 inches (both inclusive). In another embodiment, the diameters of the stops 38 are between approximately 1¼ inches and approximately 3 inches (both inclusive). In one embodiment, the stops 38 may have a diameter of approximately 1½ inches. Like feet 36, stops 38 may be formed of molded rubber, for example.

In an embodiment, the stops 38 are configured to work in cooperation with the support leg 22 to limit the tilting movement of the exercise board. As seen in FIG. 13, for example, when the support leg 22 is in its folded position and the board 12 is tilting to one side, the stop 38 and at least a side portion 64 of the support leg 22 touch the floor surface F together to stop movement of the board. Tilting movement may also be limited just using the stops 38, however. For example, when the support tube 22 is provided in its upwardly extended position, any tilting movement to either side would be limited via the stops 38 on either side.

When tilting movement via the rocker surfaces 28, 30 and thus the exercise board 12 is stopped by the stops 38 and/or support arm 22 being placed in contact with the floor surface F, the user support surface 18 is provided at an angle $\phi$ relative to the floor. In one embodiment, the angle $\phi$ of the support surface 18 is between approximately 5 degrees and approximately 15 degrees (both inclusive). In another embodiment, the angle of the support surface 18 is between approximately 8 degrees and approximately 10 degrees (both inclusive). In yet another embodiment, the angle $\phi$ is approximately 9 degrees.

FIGS. 14-26 illustrate another embodiment of the exercise board assembly 10A in accordance with this disclosure. For simplicity purposes only, similar parts as described and noted above with respect to FIGS. 1-13 have been labeled with the same reference numbers. Accordingly, it should also be understood that the features previously noted above with respect to those parts similarly apply to the embodiment of FIGS. 14-26 and thus are not necessarily repeated here and below.

Figure 14:
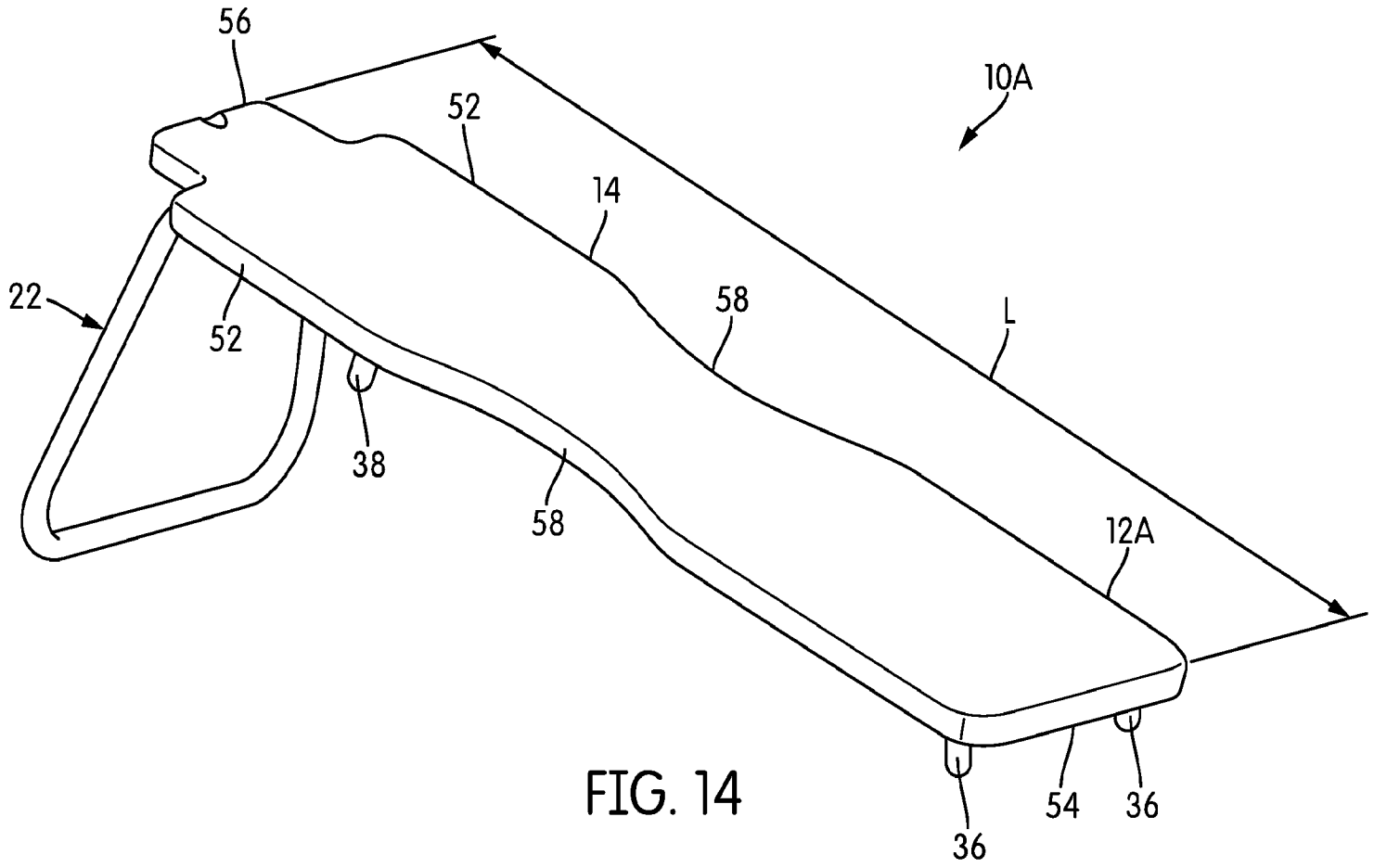
FIGS. 14-16 show an isometric view, a top end view, and a side view of an exercise board assembly with a support leg in a first position in accordance with another embodiment of this disclosure.

Exercise board assembly 10A includes an exercise board 12A, a support leg 22, and rocker surfaces 28, 30 provided via rocker blocks 24, 26. Like exercise board 12, the exercise board 12A includes a user support surface 18 on a first side 14 of the board 12A, and an opposite surface 20 on a second side 16 (or underside) of the board 12A that is opposite the first side 14. The surfaces 18, 20 of the first and second sides 14, 16 are flat. In this embodiment, however, the exercise board 12A has a substantially rectangular design, such as shown in FIG. 14, which includes a head rest portion 56 at a first end (or top or proximal end) and concavely curved side edges 58 along its sides 52. The sides 52 may include transition portions each having a radius R3 that transitions into the curved side edges 58. Each of the curved side edges 58 also have a radius R4. In an embodiment, the radius R3 of each transition portion is between approximately 3 inches and approximately 9 inches (both inclusive). In another embodiment, the radius R3 is between approximately 4 inches and approximately 6 inches (both inclusive). In one embodiment, the radius R3 of each transition portion is approximately 6 inches. In an embodiment, the radius R4 of each curved side edge 58 is between 28 inches and approximately 36 inches (both inclusive). In another embodiment, the radius R4 is between approximately 30 inches and approximately 34 inches (both inclusive). In an embodiment, the radius R4 of each curved side edge 58 is approximately 32 inches.

Figure 18:
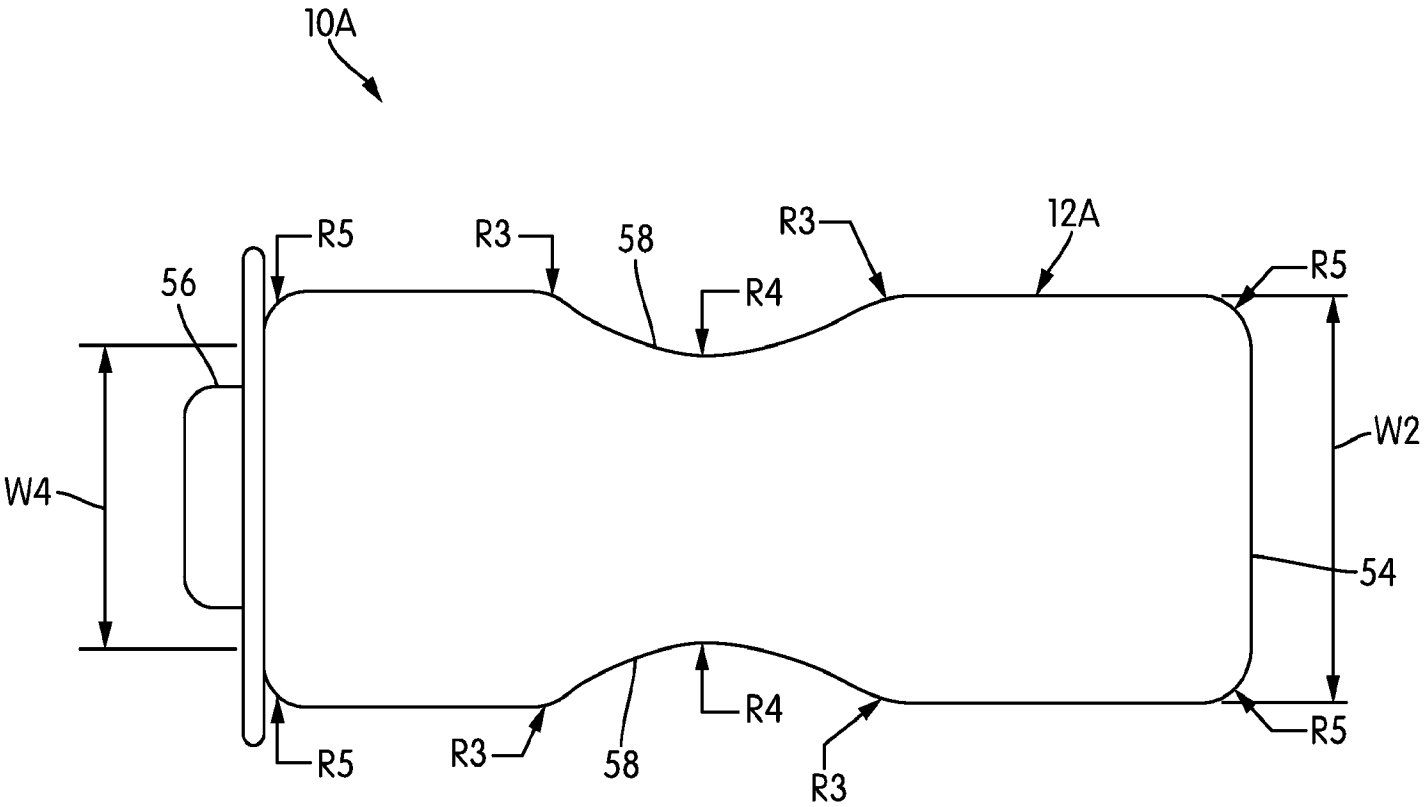
Figure 19:
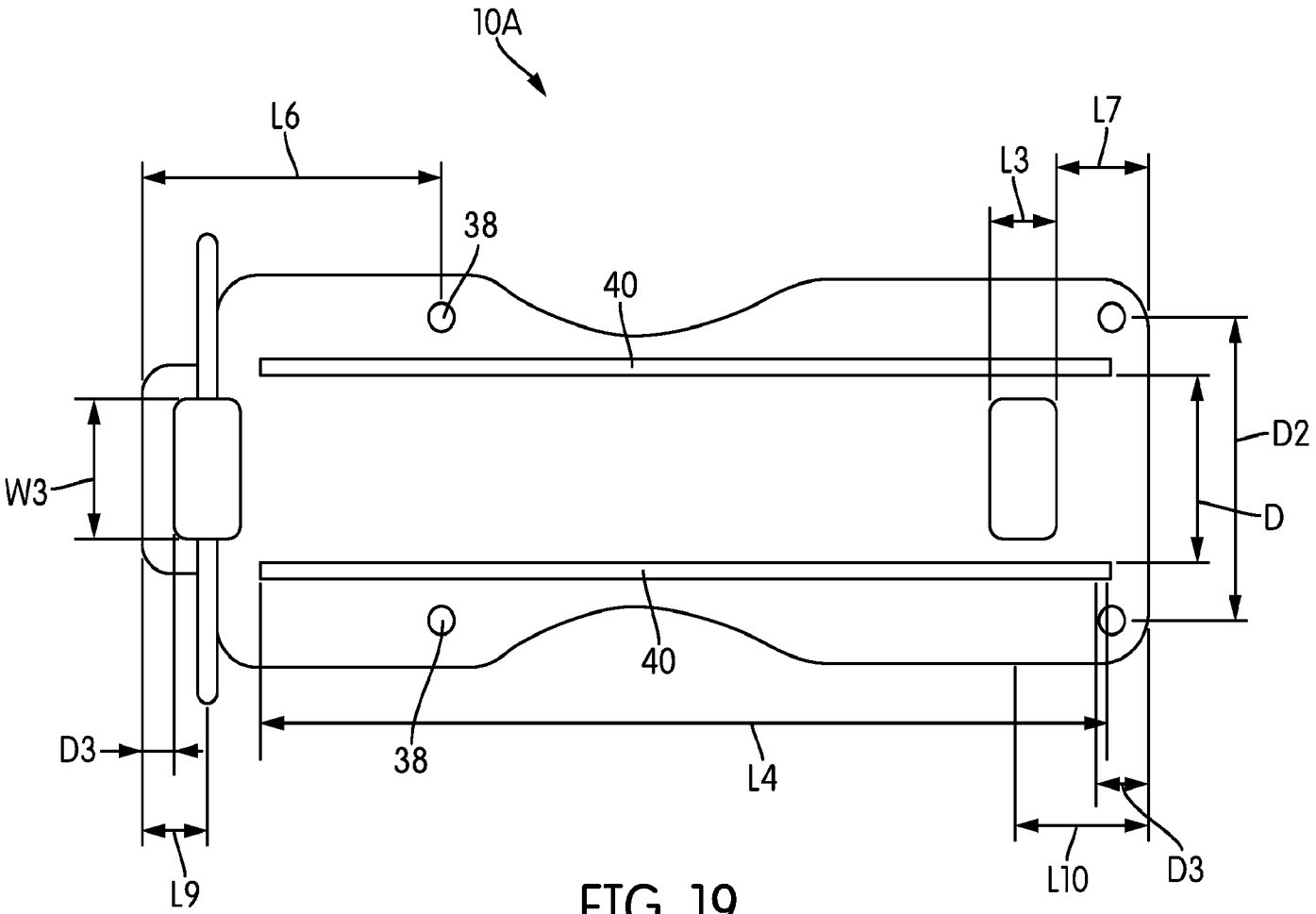
Figure 20:
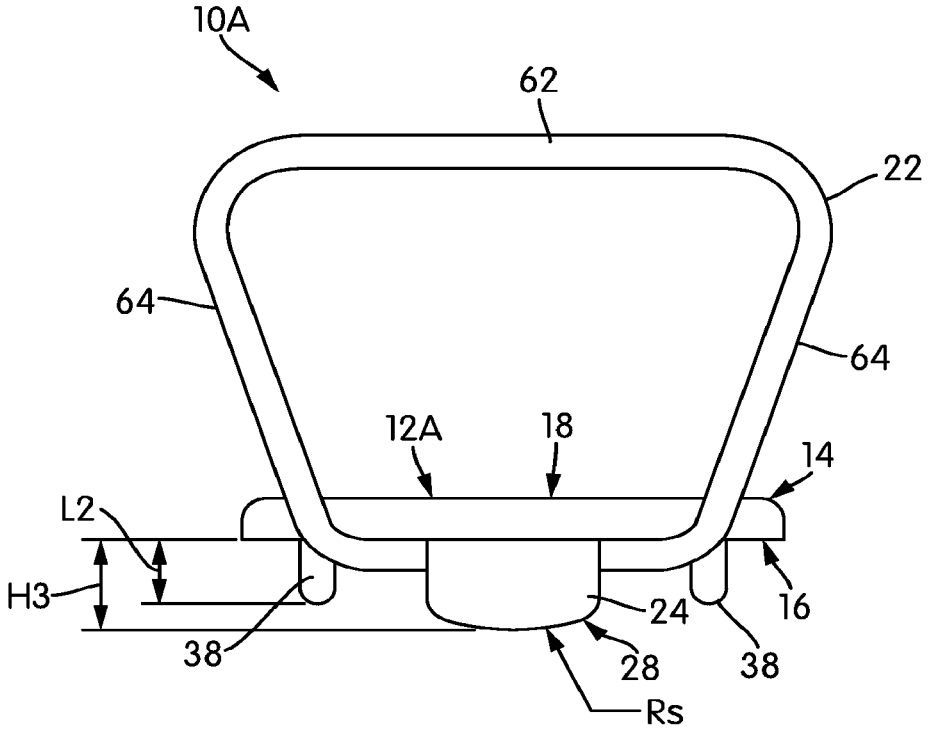
Figure 21:
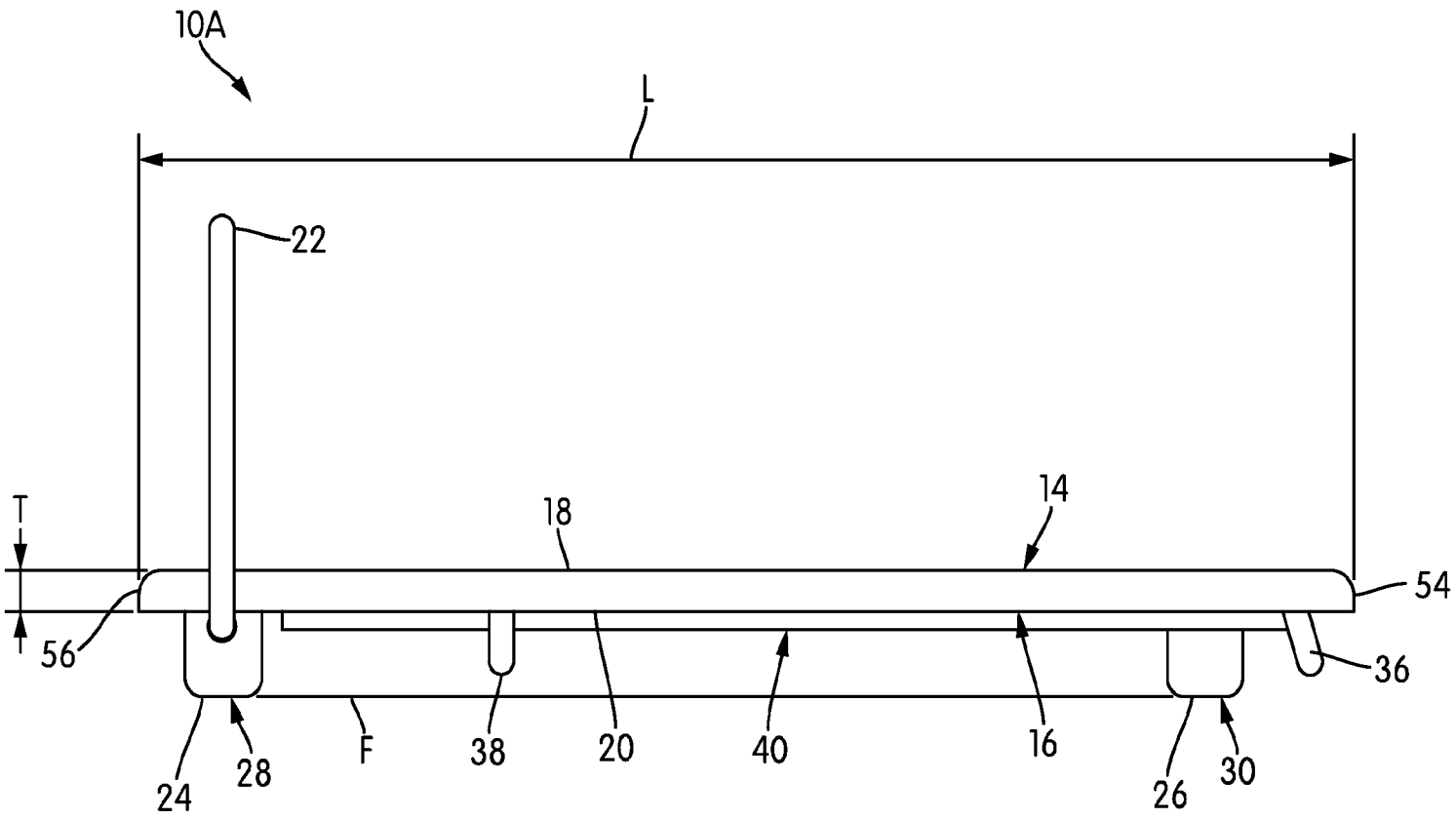

The exercise board 12A also has a width W4 between the curved side edges 58 (see FIG. 18). In an embodiment, the width W4 is between approximately 12 inches and approximately 24 inches (both inclusive). In another embodiment, the width W4 is between approximately 14 inches and approximately 20 inches (both inclusive). A width W4 of the board 12A between the curved side edges 58 may be approximately 17 inches, in accordance with one embodiment.

The exercise board 12A may also include rounded edges of radius R5 in each of the corners at a second (bottom) end 54 thereof as well as at a first (top) end 52. In an embodiment, the radius R5 of each corner is between approximately 2 inches and approximately 10 inches (both inclusive). In another embodiment, the radius R5 is between approximately 2.5 inches and approximately 8 inches (both inclusive). In yet another embodiment, the radius R5 is between approximately 4 inches and approximately 6 inches (both inclusive). In still yet another embodiment, the radius R5 of each corner is approximately 3.15 inches.

Figure 22:
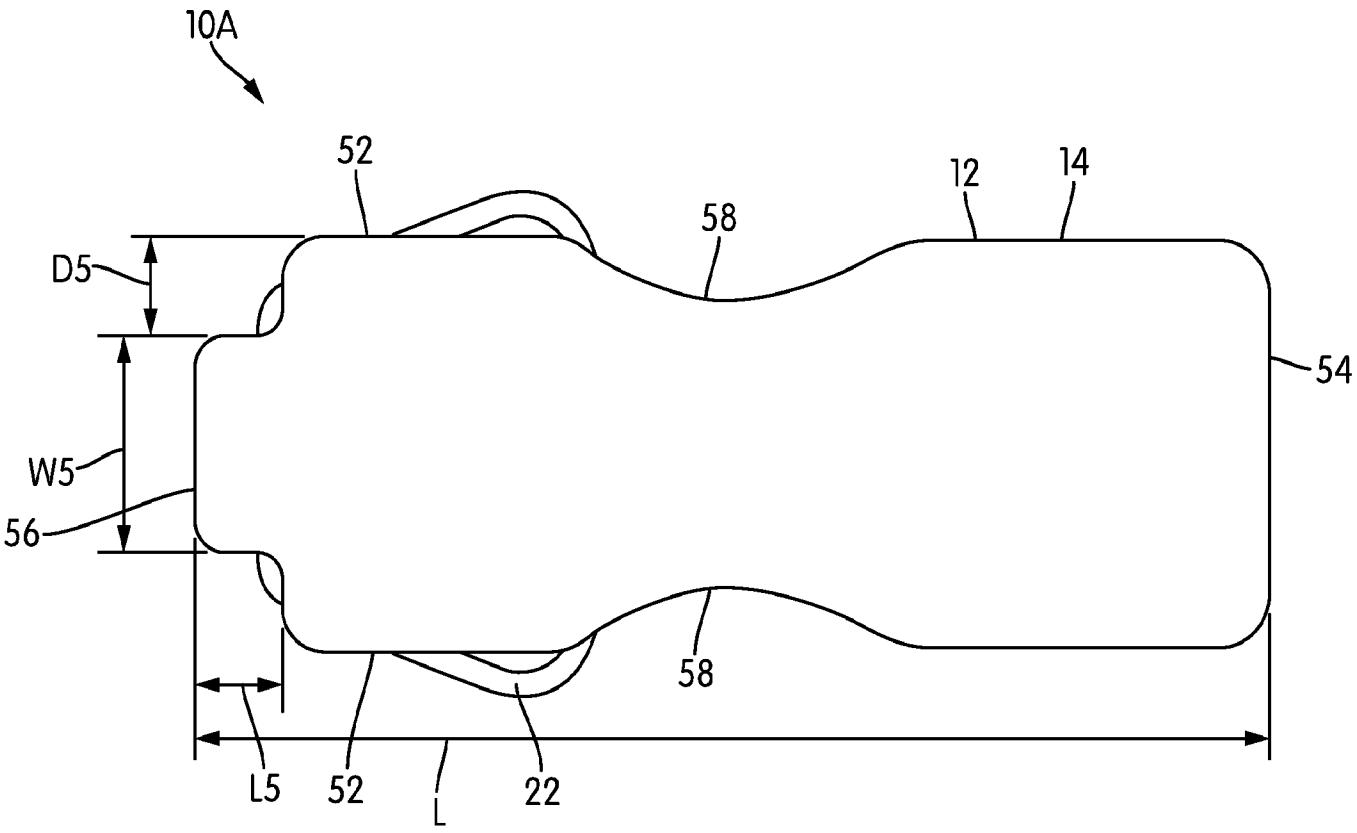
FIGS. 22-24 show a top view, a side view, and a bottom view of the exercise board assembly of FIG. 14 with the support leg in a third position and a rocker surface in accordance with an embodiment of this disclosure.

As shown in FIG. 22, the head rest portion 56 is centered along the centerline of the exercise board 12A, at first end, with a distance D5 extending from its outside edge to an outer edge on either side 52. The headrest portion 56 also has a length L5 measured longitudinally from a topmost side to a transition portion and a width W5 measured laterally between its side edges. In an embodiment, D5 and L5 are similar in dimension or size. In an embodiment, the D5 and L5 are between approximately 2 inches and approximately 6 inches (both inclusive). In another embodiment, the D5 and L5 are between approximately 2.5 inches and approximately 4.5 inches (both inclusive). In one embodiment, D5 and L5 are each approximately 5½ inches. Of course, such dimensions need not be similar or the same. In one embodiment, L5 is greater than D5 (L5>D5). In another embodiment, L5 is less than D5 (L5<D5). In an embodiment, the width W5 of the head rest portion 56 is between approximately 10 inches and approximately 16 inches (both inclusive). In another embodiment, the width W5 is between approximately 12 inches and approximately 14 inches (both inclusive). In one embodiment, the width W5 of the head rest portion 56 is approximately 13 inches.

In an embodiment, any number of feet 36 may be provided on the board 12A. The feet 36 may be mounted to extend from the opposite side 20 of the board 12A. For example, as shown in greater detail in FIG. 19, at or near the flat edge 54 at the second (bottom) end of the exercise board assembly 10A are two feet 36 that are part of the assembly 10A. The exercise board 12A also includes two stops 38, to limit an amount or a range of rocking movement of the exercise board 12A relative to the floor surface F.

Figure 16:
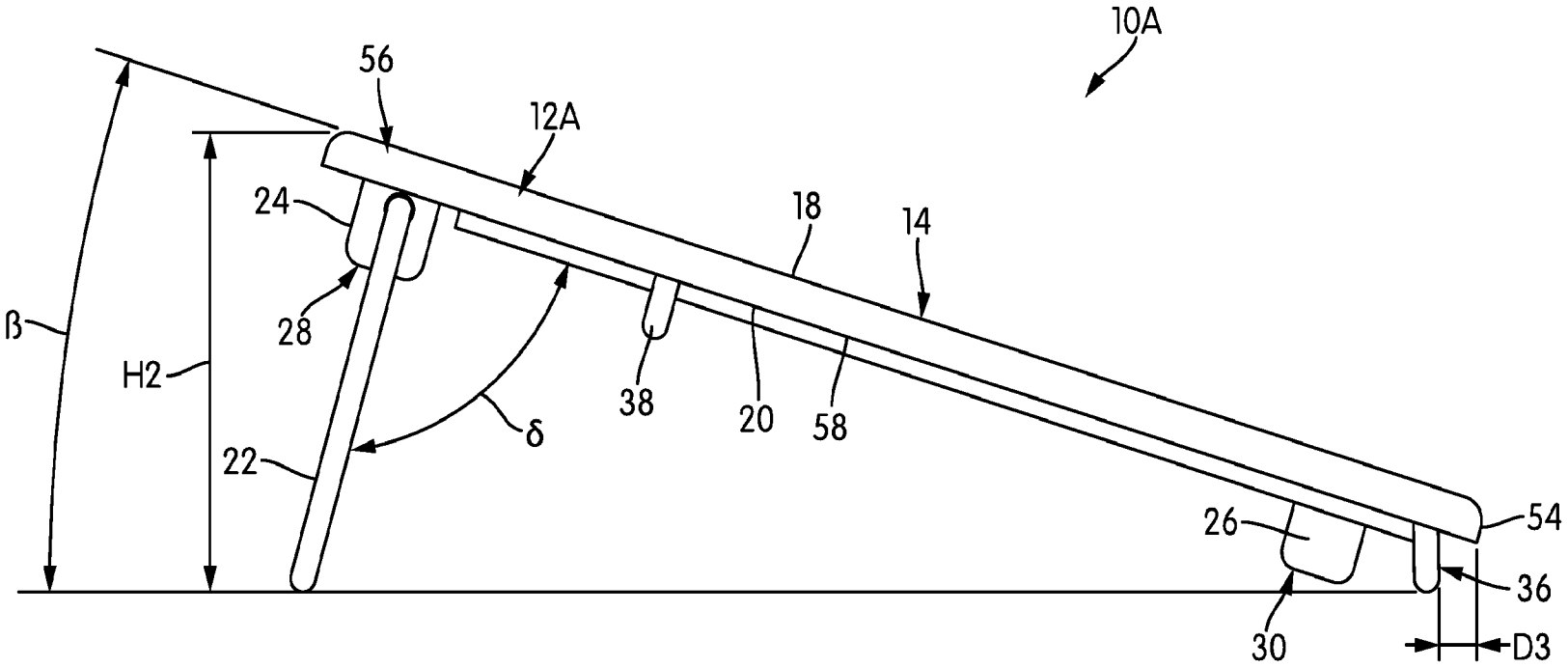
Figure 17:
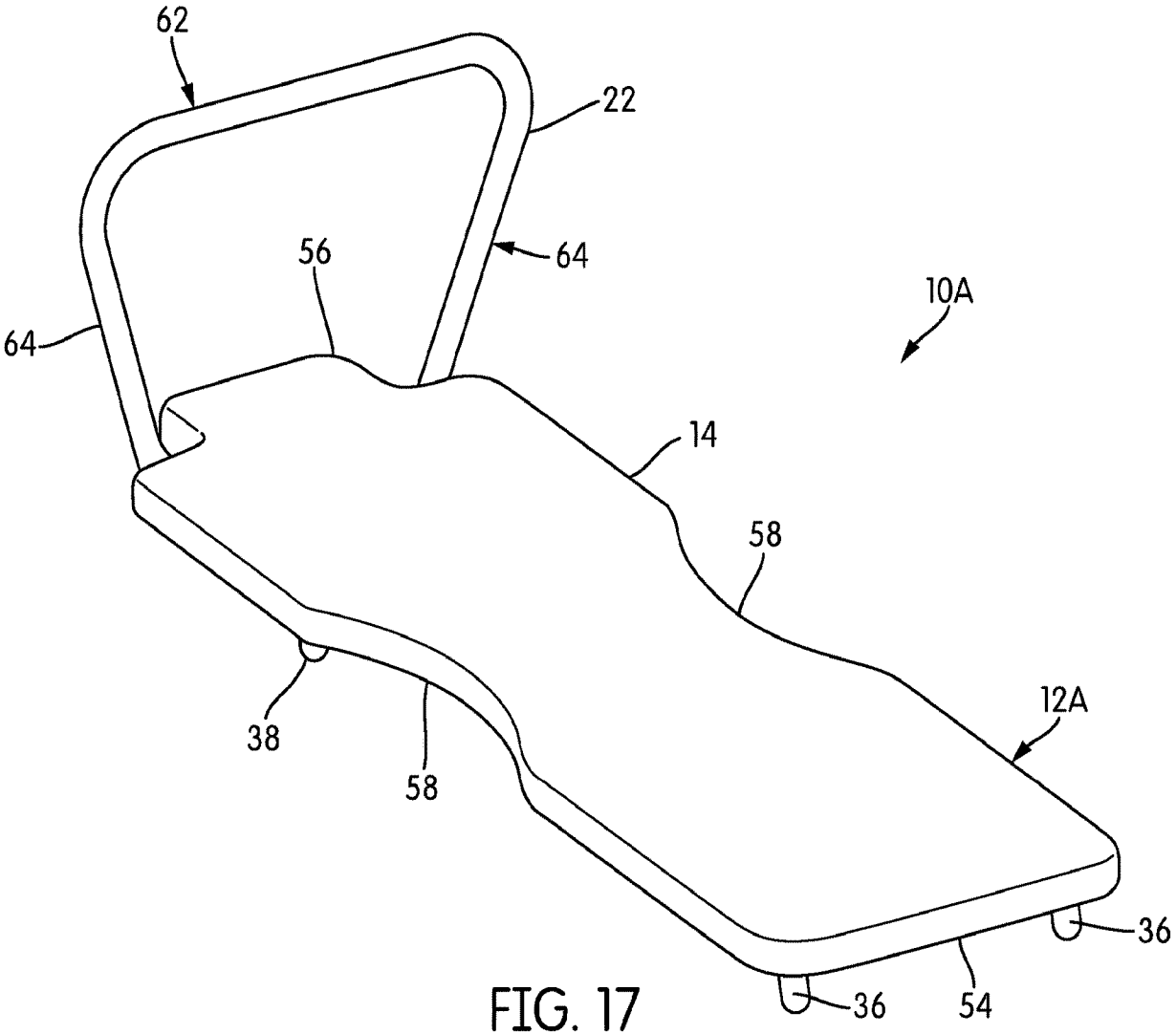
FIGS. 17-21 show an isometric view, a top view, a bottom view, a top end view, and a side view of the exercise board assembly of FIG. 14 with the support leg in a second position in accordance with an embodiment of this disclosure.

An exemplary first position for the support leg 22 used with the exercise board 12A in exercise board assembly 10A is illustrated in FIGS. 14-26. The support leg 22 is in a deployed, downwardly extended position. In this first position, the support leg 22 is positioned below the second side 16 of the board 12A and arranged to support the exercise board 12A in a stable angled or inclined configuration with respect to a floor surface F, as seen in FIG. 16, for example. The feet 36 provided at the second (bottom) end of the board 12A also engage the floor surface F.

Figure 23:
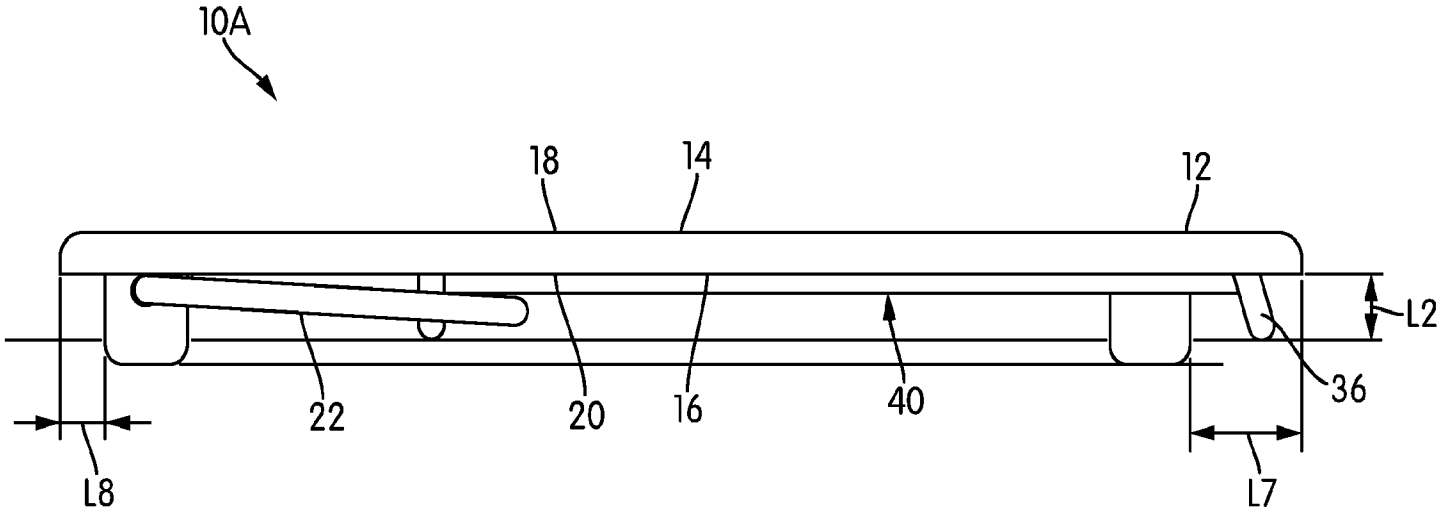
Figure 24:
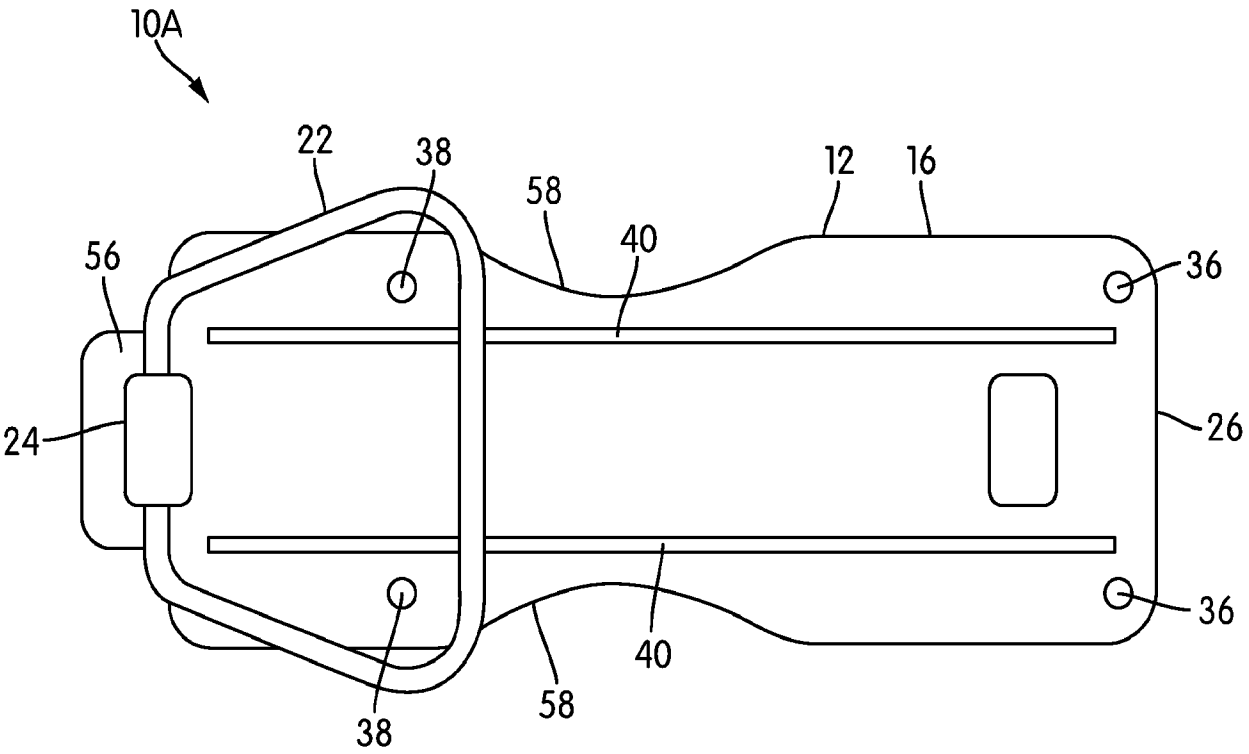

FIGS. 17-21 illustrate the support leg 22 in an upwardly extending (or second) position relative to the exercise board 12A. The support leg 22 extends above the user support surface 18, and rocker surfaces 28, 30 of the rocker blocks 24, 26 engage and contact the floor surface F. FIGS. 22-24 show the support leg 22 in a folded (or third) position relative to the exercise board 12A. The support leg 22 is folded and extends generally alongside the opposite surface 20 of the board 12A, as shown in FIG. 23, for example. The support leg 22 is positioned such that the entire structure thereof is positioned closer to the opposite surface 20 than at least a portion of the rocker surface 28. In an embodiment, the support leg 22 may be positioned in contact with the tubes 40 in this folded position.

Although not shown in the Figures, it should be understood that exercise board assembly 10A may further position its support leg 22 in a fourth position, e.g., such that the support leg 22 may extend forwardly relative to the first (top) end of the exercise board 12A and away from the surfaces 18 and 20 thereof, as previously described in the first embodiment.

Figure 25:
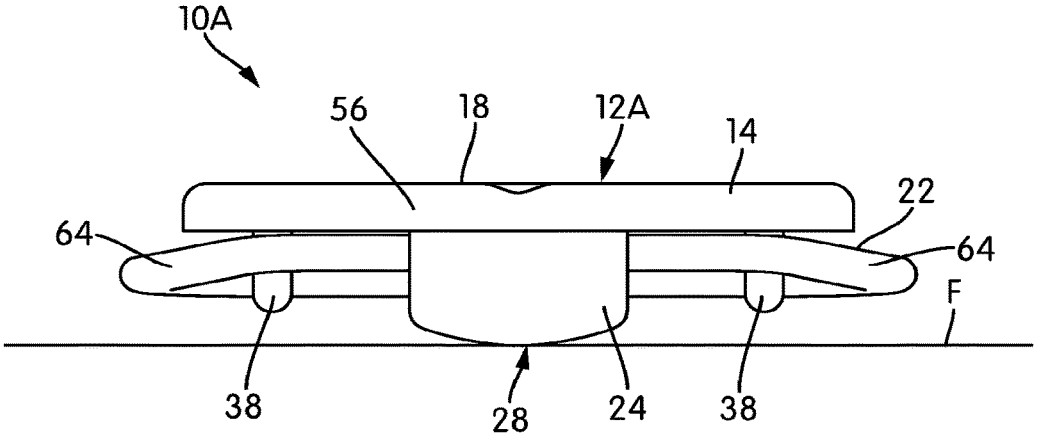
FIGS. 25-26 show a top end view of the exercise board assembly of FIG. 14 with the support leg in a third position and exemplary movement of the rocker surface relative to the floor surface in accordance with an embodiment of this disclosure.
Figure 26:
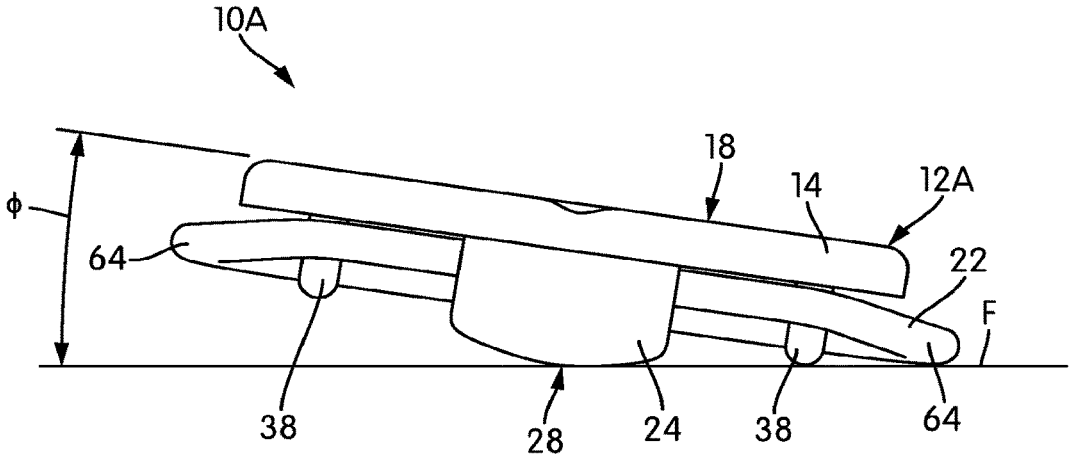

FIGS. 25-26 show a top end view of the exercise board assembly 10A with the support leg 22 in a folded position and movement of the rocker surfaces 28, 30 relative to the floor surface F in accordance with an embodiment of this disclosure. The exercise board 12A is configured to move in a similar manner as described previously with respect to exercise board 12. Further, stops 38 and/or the support tube 22 may be used to limit tilting motion of the exercise board 12 in either direction.

FIGS. 27-31 illustrate yet another embodiment of the exercise board assembly 10B in accordance with this disclosure. For simplicity purposes only, similar parts as described and noted above with respect to FIGS. 1-13 and FIGS. 14-26 have been labeled with the same reference numbers. Accordingly, it should also be understood that the features previously noted above with respect to those parts similarly apply to the embodiment of FIGS. 27-31 and thus are not necessarily repeated here and below.

Exercise board assembly 10B includes an exercise board 12B, a support leg 22, and rocker surfaces 28, 30 provided via rocker blocks 24, 26. Like exercise board 12, the exercise board 12B includes a user support surface 18 on a first side 14 of the board 12B, and an opposite surface 20 on a second side 16 (or underside) of the board 12B that is opposite the first side 14. In accordance with an embodiment, the surfaces 18B, 20B of the first and second sides 14, 16 can be curved.

Figure 30:
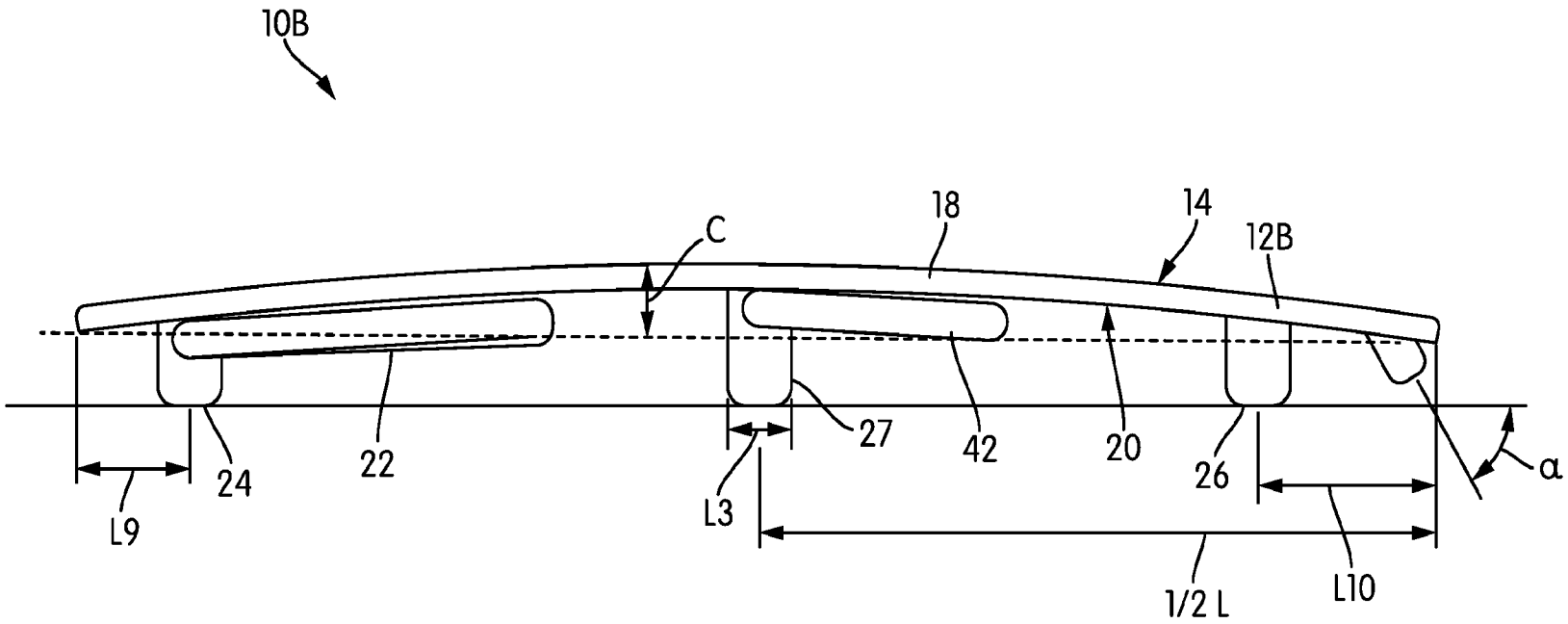

As depicted in FIG. 30, for example, the surfaces 18B, 20B may have a curvature rise C such that they curve relative to a horizontal plane of the floor surface F. In another embodiment, only surface 18B has a curvature and is configured to have a curvature rise (like curvature rise C) that curves relative to the flat, opposite surface 20B on the second side 16 of the exercise board 12. In an embodiment, the curvature rise C of at least user support surface 18 (relative to either the floor surface F or the opposite surface 20) is between approximately ½ inch and approximately 4 inches (both inclusive). In another embodiment, the curvature rise C is between approximately 1 inch and approximately 3 inches (both inclusive). In one embodiment, the curvature rise C of at least user support surface 18 (relative to either the floor surface F or the opposite surface 20) is approximately 2 inches.

In accordance with an embodiment, the exercise board 12 of FIGS. 1-13 and/or the exercise board 12A of FIGS. 14-26 has a curvature rise in its board, as described above.

Also, concavely curved side edges 58 are provided on the exercise board 12B, such as shown although a separately extending headrest portion is not included (as shown in the embodiment of FIG. 14, for example). In accordance with one embodiment, a head rest (like head rest portion 56 as shown in FIG. 14) may be provided on the exercise board 12B. Also, The exercise board 12B may also include rounded edges of radius R5 in each of the corners at a second (bottom) end 54 thereof as well as at a first (top) end 52, as shown in FIG. 29, for example.

The exercise board assembly 10B of FIGS. 27-31 also includes a second support leg 42 pivotally mounted to the exercise board 12B. Like support leg 22, the second support leg 42 is constructed and arranged to be secured in at least two positions, including a deployed, downwardly extended position, wherein the second support leg 42 is arranged to support the board 12B in a stable angled configuration with respect to a floor surface F on which the exercise board assembly is positioned, and a folded position wherein the support leg 42 extends generally alongside the opposite surface 20.

Figure 27:
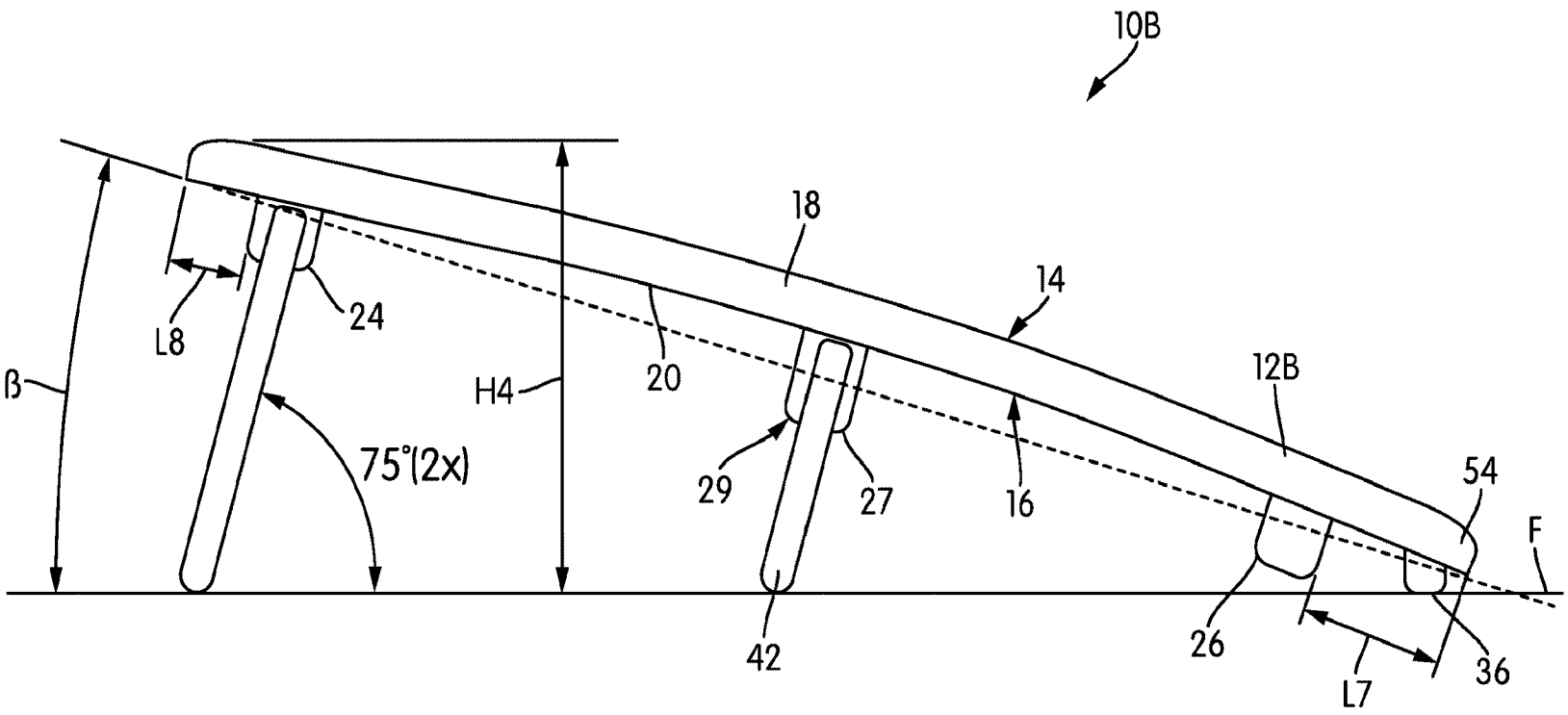
FIGS. 27-28 show a side view and a top end view of an exercise board assembly with two support legs in a first position in accordance with yet another embodiment of this disclosure.
Figure 28:
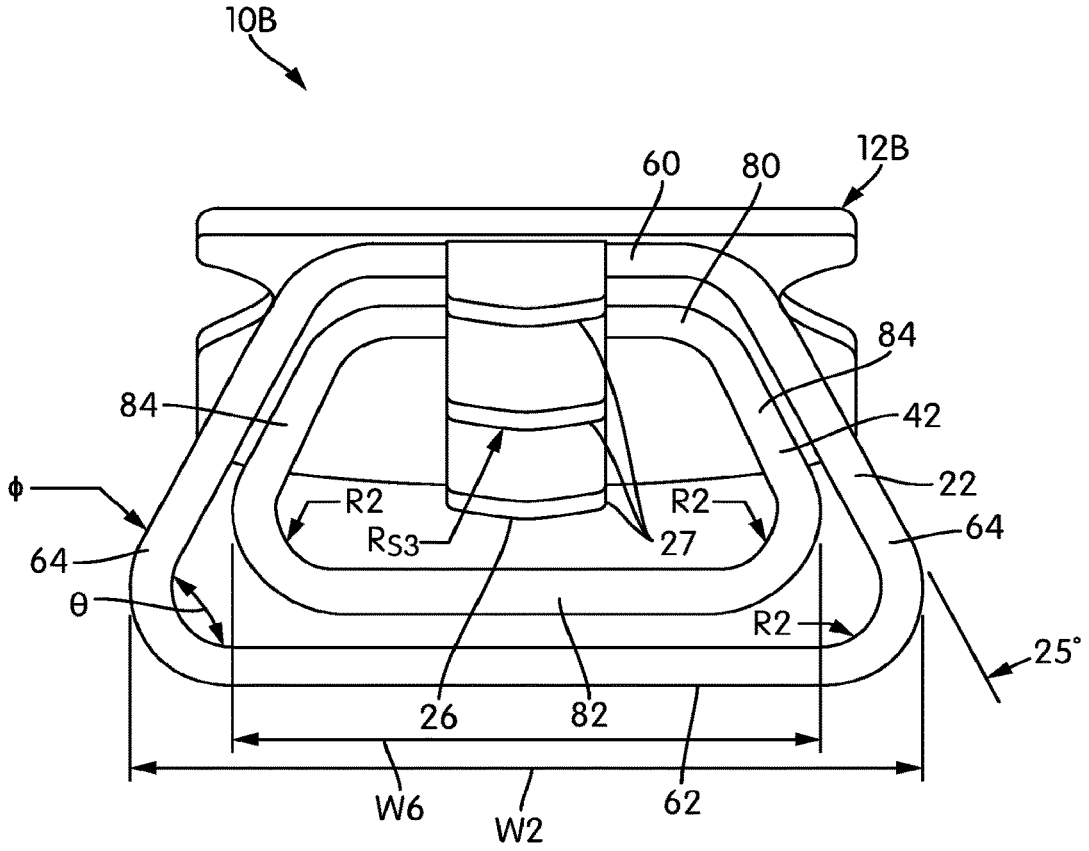
Figure 29:
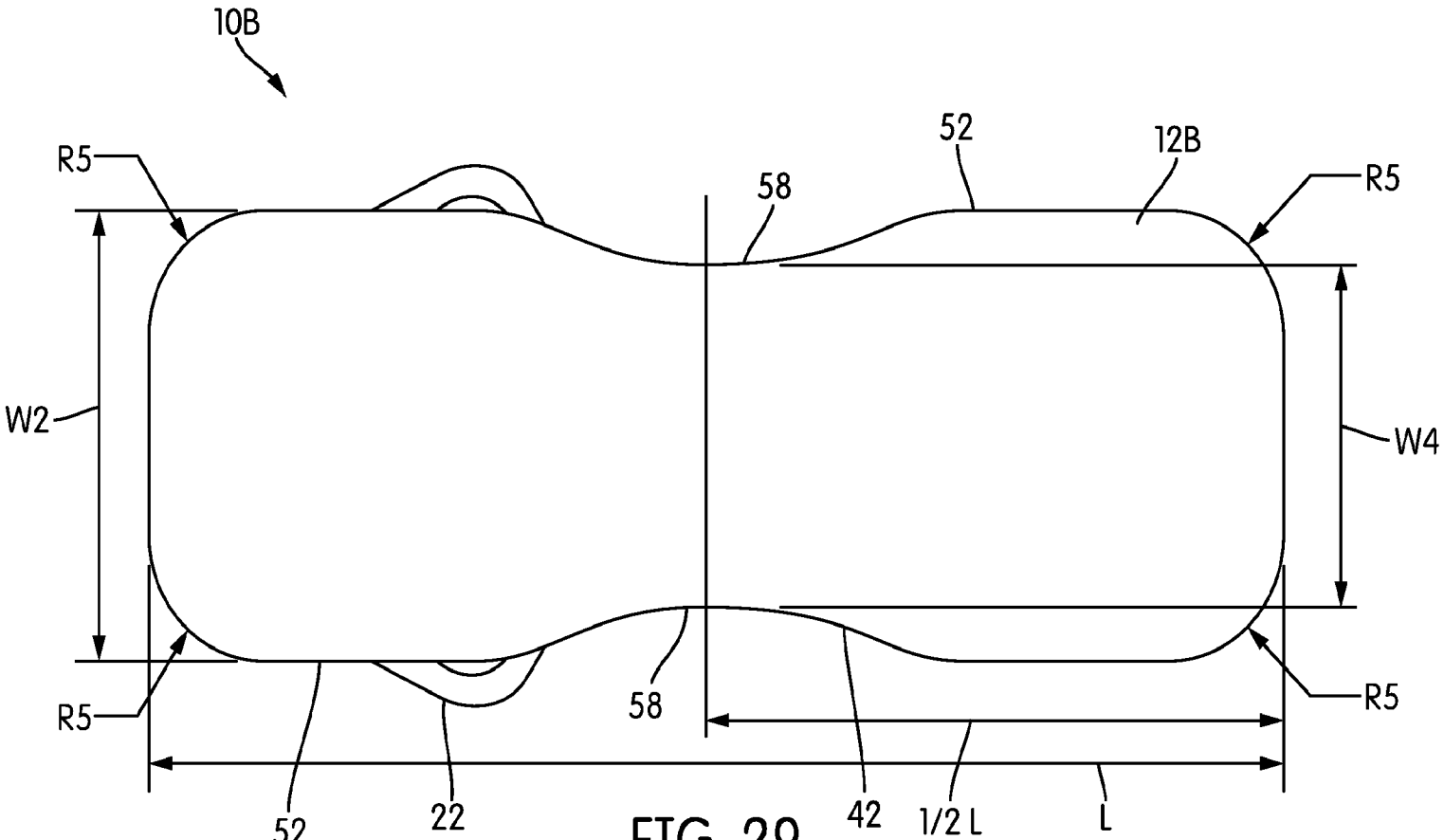
FIGS. 29-31 show a top view, a side view, and a bottom view of the exercise board assembly of FIG. 27 with the support legs in a second position in accordance with an embodiment of this disclosure.

As shown in FIGS. 27 and 30, for example, the second support leg 42 may be mounted to the exercise board 12B on the second side 16 near a center or middle of the board 12 (e.g., at or near a length ½ L, seen in FIG. 29). The second support leg 42 is constructed and arranged to be secured in multiple positions relative to the exercise board 12B along with the support leg 22. As best seen in FIG. 28, like support leg 22, the second support leg 42 also has a substantially trapezoidal shape. The second support leg 42 includes parallel sides in the form of a top portion 80 and a bottom portion 82, and angled side portions 84 between the top portion 80 and bottom portion 82. The angled side portions 84 may be positioned at an angle Θ relative to the bottom portion 82. For example, in accordance with an embodiment, the angle Θ is between approximately 70 degrees and approximately 75 degrees. In one embodiment, the angle Θ is approximately 71 degrees. The top portion 80 has a length that is smaller than the bottom portion 82. In an embodiment, the overall width W6 of the bottom portion 82 of the second support leg 42 extends between approximately 12 inches to approximately 24 inches. In one embodiment, the width W6 of the bottom portion 82 is approximately 14 inches to approximately 22 inches (both inclusive). In another embodiment, the width W6 of the bottom portion 82 is approximately 16 inches. The edges of the second support leg 42 may be rounded and formed from a tube or a bar that is bent or molded, for example. In one embodiment, the second support leg 42 is formed from 1.5 inch diameter tubing. The second support leg 42 may have curved portions of radius R1 transitioning from the top portion 80 into the angled side portions 84. The second support leg 42 may also include bottom curved portions of radius R2 between the angled side portions 84 and bottom portion 82. In an embodiment, R2>R1. In one embodiment, R1 is approximately 2.75 inches. In an embodiment, R2 is approximately 4 inches.

In addition, the exercise board assembly 10B further includes a third rocker block 27 with a third rocker surface 29 disposed thereon. In an embodiment, the second support leg 42 has a portion thereof pivotally supported by the third rocker block 27. In one embodiment, a top portion of the second support leg 42 extends through openings in the rocker block 27.

The third rocker block 27 is attached to the opposite surface 20 of the exercise board 12B. The third rocker block 27 spaced from and provided between the rocker block 24 and the second rocker block 26 on the board 12B, as shown in FIG. 30, for example. In an embodiment, the rocker block 24 is provided adjacent a first (top) end of the board 12B and the second rocker block 26 is provided at a second (bottom) end of the board 12B, and the third rocker block 27 is provided near or at a center of the board 12B. The third rocker block 27 and its rocker surface 29 may also be used to support the exercise board 12B on the floor surface F when the support legs 22 and 42 are in one or more positions away from contact with the floor (e.g., see FIG. 30). The third rocker block 27 may be centered relative to a centerline extending longitudinally through the exercise board 12B as well. The third rocker surface 29 is curved and engageable with the floor surface F to cause the user support surface 18 to be unstable for a user supported thereby. The radius of curvature Rs3 of the rocker surface 29 may be the same as or similar to the radius of curvature Rs, Rs2 of the rocker surfaces 28, 30. The radius of curvature Rs3 of the rocker surface 29 may be within a range of approximately 18 inches and approximately 22 inches (both inclusive) in accordance with an embodiment. In one embodiment, the radius of curvature Rs3 for the rocker block 27 is approximately 20 inches.

In an embodiment, two feet 36 are mounted to extend from the opposite side 20 of the board 12B. Stops 38, however, need not be included with the exercise board assembly 12B.

An exemplary first position for the support legs 22 and 42 used with the exercise board 12B in exercise board assembly 10B is illustrated in FIGS. 27-28. The support leg 22 and support leg 42 are each in a deployed, downwardly extended position. In this first position, the support legs 22, 42 are positioned below the second side 16 of the board 12B and arranged to support the exercise board 12B in a stable angled or inclined configuration with respect to a floor surface F, as seen in FIG. 27, for example. The feet 36 provided at the second (bottom) end of the board 12B also engage the floor surface F.

Also shown in FIG. 27, when the assembly 10B is provided in the first position such that the support legs 22, 42 and feet 36 are in contact with the floor surface F, the user support surface 18 is provided at an angle β relative to the floor. A highest or first (top) end portion of the user support surface 18 is positioned at a height H4 from the floor surface F. In an embodiment, the height H4 is between approximately 12 inches and approximately 22 inches. In another embodiment, the height H4 is between approximately 15 inches and approximately 19 inches. In one embodiment, the height H4 is approximately 17 inches.

Figure 31:
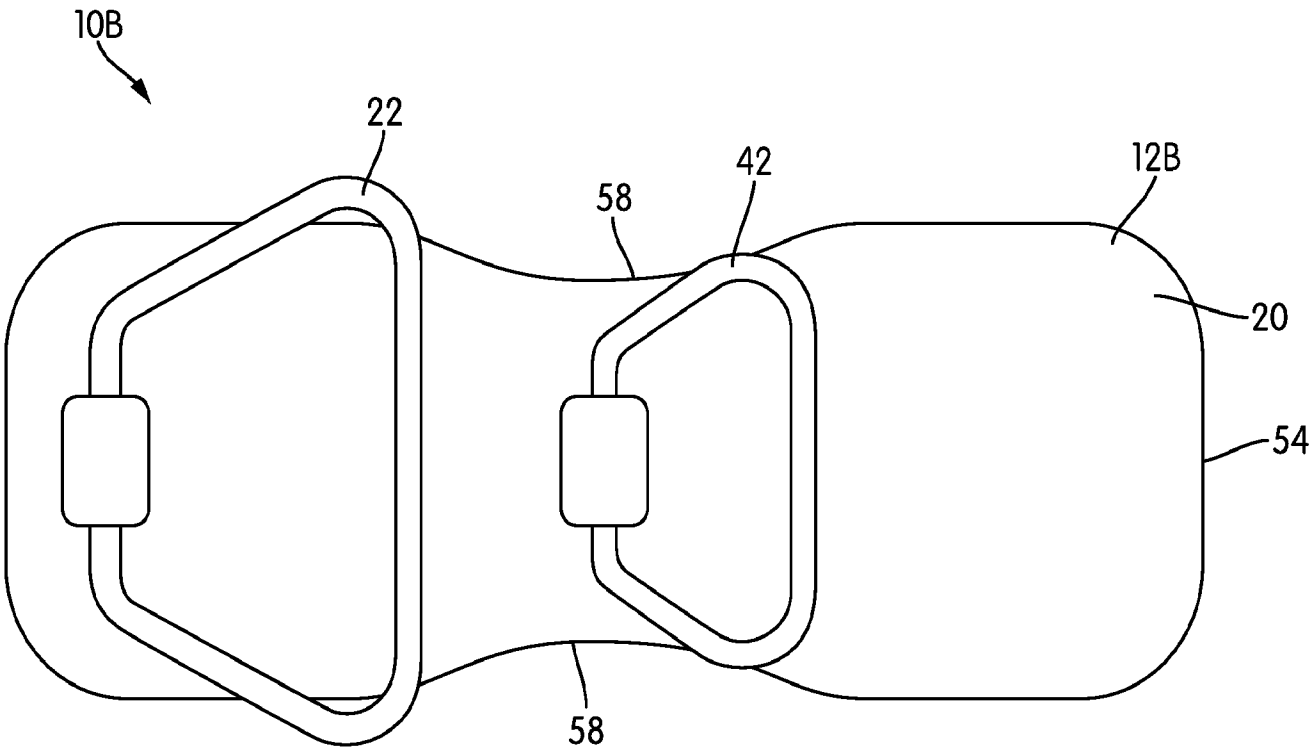

FIGS. 29-31 show the support legs 22, 42 in a folded (or second) position relative to the exercise board 12B. The support legs 22, 42 are folded underneath and extend generally alongside the opposite surface 20 of the board 12B, as shown in FIG. 30, for example. The support legs 22, 42 are positioned such that their entire structures are positioned closer to the opposite surface 20 than at least a portion of the rocker surfaces 28, 29.

Although not shown in the Figures, it should be understood that exercise board assembly 10B may further position its support legs 22, 42 in a third position, e.g., such that the support legs 22, 42 may both extend in a forward direction.

Figure 32:
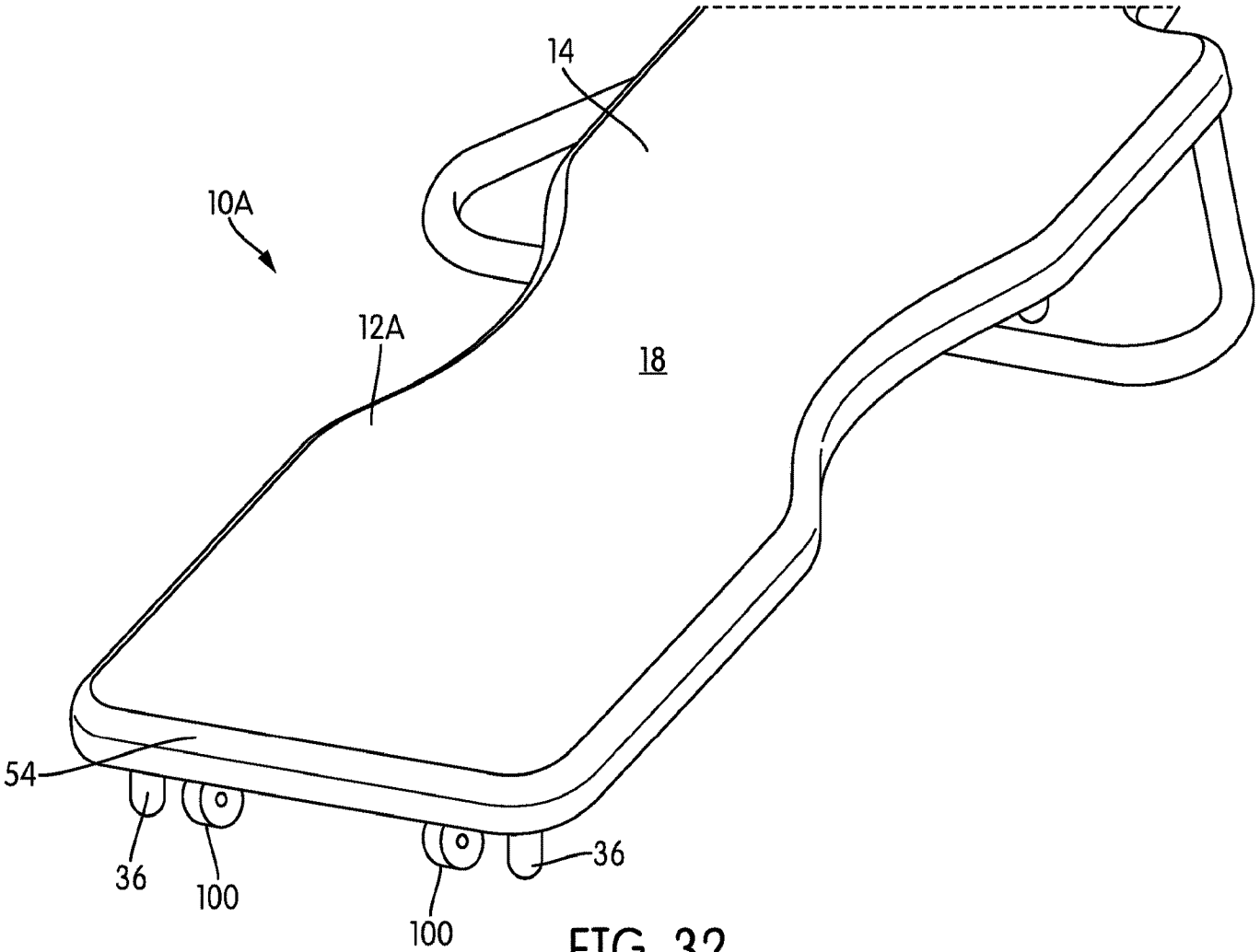
FIG. 32 is a detailed bottom end view of wheels for use on the exercise board assembly in accordance with an embodiment herein.
Figure 33:
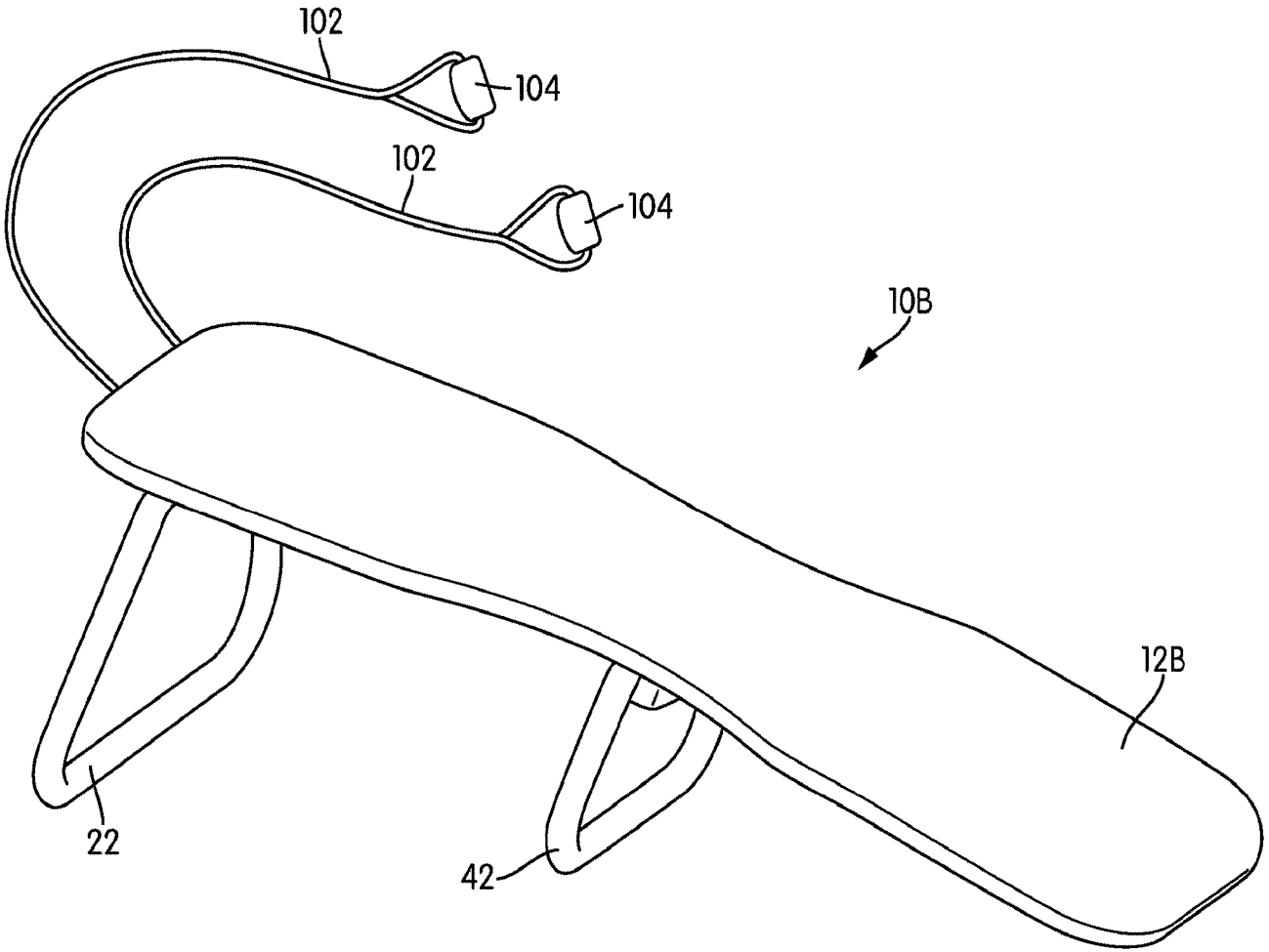
FIG. 33 is an isometric view of an exercise board assembly with an accessory in accordance with an embodiment herein.
Figure 40:
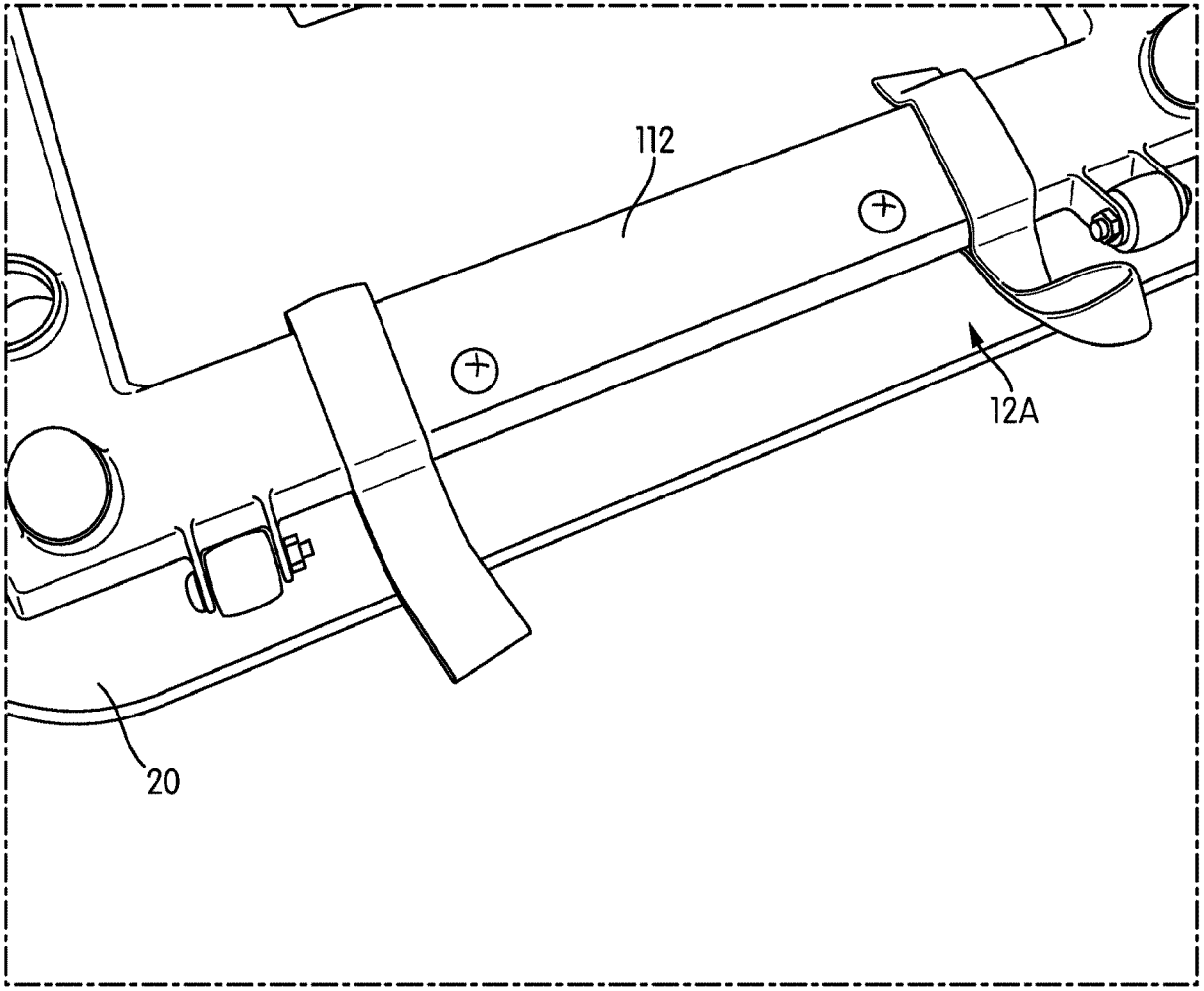
FIG. 40 is a detailed end view of a bottom end of an exercise board with loops for attaching accessories to the exercise board, in accordance with an embodiment.
Figure 41:
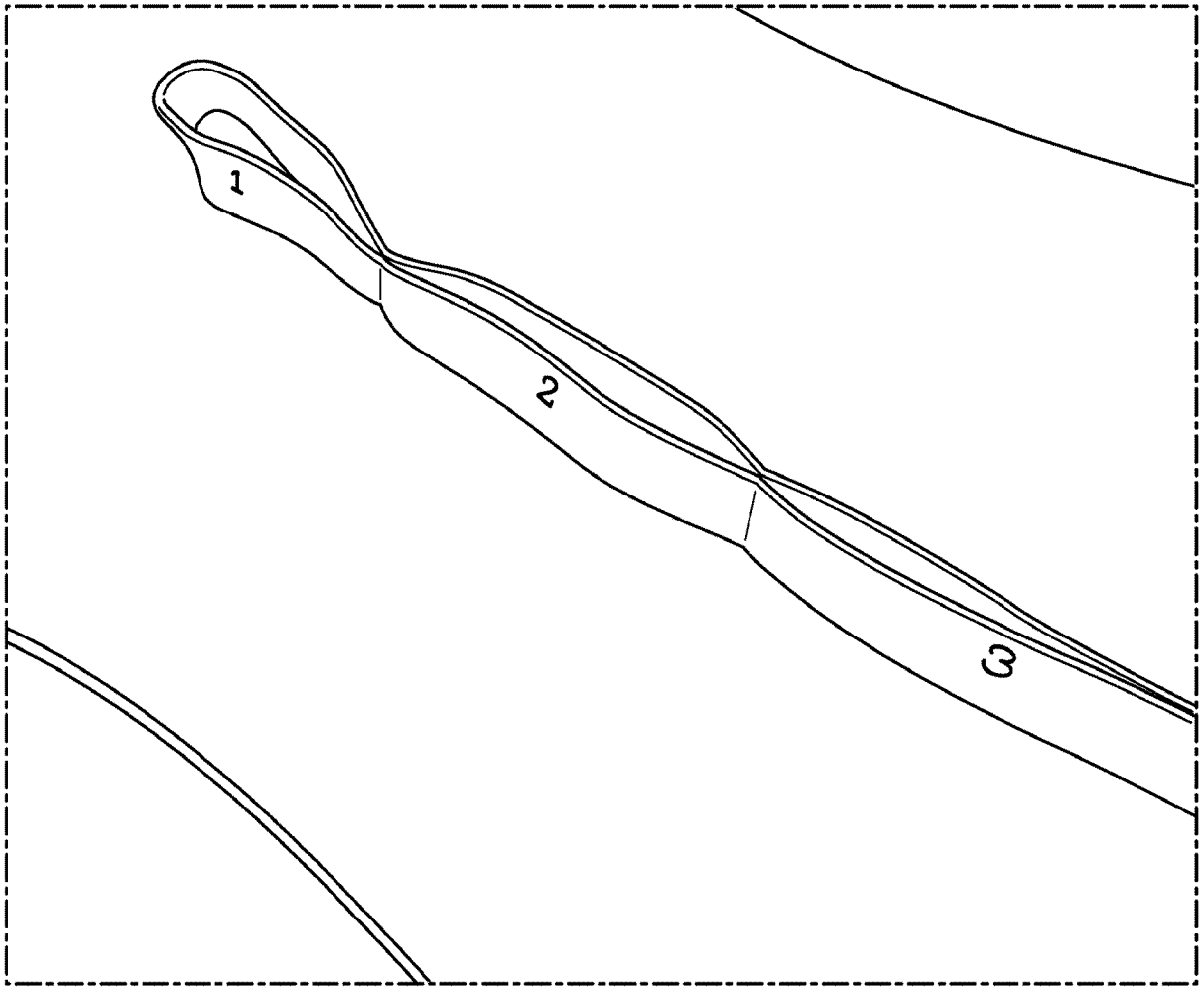
FIG. 41 is an example of an accessory for use with the exercise board assembly in accordance with an embodiment.

Additional accessories and/or options may also be provided in any of the described and/or illustrated embodiments disclosed herein. For example, as shown in FIG. 32, wheels 100 may be provided on any of the disclosed exercise boards (shown here on exercise board 12A) to assist in moving the board across the floor surface F or into storage, for example. In FIG. 32, two wheels 100 are mount to a second side 16 at or near the second (bottom) end of the board 12A in accordance with an embodiment. In another embodiment, the wheels 36 may be mounted to the feet 36 and/or near the first (top) side of the board 12A. FIG. 33 illustrates another accessory, in the form of strap(s) 102, which may be used with the exercise board assembly, shown here as assembly 10B as an example only. Although two separate straps 102 are shown, one singular strap may also be used. Further, the straps may include loops (e.g., in the form of looped material) on the ends thereof or handles 104 thereon for the user to grasp. FIG. 41 shows one example of a strap having three hand hold loops that may be used with the assembly. These loops allow a user to change the length of the strap without dismounting it from the board 12A. The strap(s) 102 may be secured on to an underside of the assembly 10B, such as on the support leg 22 and/or the board 12B itself, in any number of ways, including, but not limited to via hook and look material or ties. FIG. 40 shows an additional location at the back of the board 12A in which strap(s) 102 may be attached. The strap(s) 102 may be attached to loops of material provided on the frame 112, and/or directly to the frame 112, for example.

In addition or alternatively, bungee cords and/or stretch bands may also be used with any of the herein disclosed assemblies.

In another embodiment, one or more notches or cut-outs (not shown) may be provided in the exercise board of any of the disclosed embodiments for the user to grab onto using their hands and/or feet. In yet another embodiment, handles or grips (not shown) may be provided on or with the exercise board for the user to grasp onto using their hands and/or feet. For example, handles or grips may be provided on an underside or second side 16 of the board near the sides or first (top) end.

In another embodiment, a mat or pad, a matting material, or a material for increasing resistance may be provided on the user support surface 18. For example, in one embodiment, the user support surface 18 has a non-slip coating thereon. This non-slip surface can be formed from a number of materials and applied in any number of ways, including, but not limited to, a paint with grit, a non-slip spray, and/or a non-slip adhesive back sheet or strips, for example.

In yet another embodiment, one or both of the rocker blocks 24, 26 may be designed to be detachably mounted to the exercise board 12 in any of the above embodiments. For example, the rocker blocks 24, 26 may be removed from the opposite side 20 of the exercise board 12. In one embodiment, each of the rocker blocks 24, 26 is replaceable with another rocker block that has a different contact surface comprising a different radius of curvature as compared to the detached rocker blocks 24, 26.

It should be noted that any description throughout this disclosure that relates to numbering of the positions and use of the terms first, second, third, and fourth with reference to each of the positions of the support leg 22 relative to the exercise board 12 is not intended to be limiting. Such terms have been used interchangeably in each of the herein described exemplary embodiments for explanatory purposes only.

During use in the first position of FIG. 1, a user may utilize the exercise assembly 10 in a number of ways to perform multiple exercises. For example, in one exercise, a user may straddle the user support surface 18 by placing their legs adjacent either side 52 of the board 12, and then alternately lift each leg to contact or tap the top of the user support surface 18 with their foot. In another exercise, the user may stand adjacent to the second (bottom) end of the exercise board 12, facing forward towards the user support surface 18, and perform alternating lunges by alternately moving and placing each foot forwardly onto a center or middle of the user support surface 18 and bending at the knee. In one embodiment, the user may utilize one or more strap(s) 102 (such as shown in FIG. 33) to assist in performing this or any of the exemplary described exercises. For example, the strap(s) 102 may be used to assist in performing the exercise and elevating a user's heart rate (e.g., by simultaneously lifting their arms above their head while performing the alternating lunges, or moving their arms towards and away from each other while performing the exercise), as well as to assist in maintaining stability. Another exemplary exercise includes a user standing on the user support surface 18 at or near the second (bottom) end of the board 12 and performing squats relative to the board 12 while in the first (inclined) position. By standing on the user support surface 18 in this position, the user is forced to engage their heels and maintain or stay in such a position while performing the squatting exercises, thus targeting the motion where desired (e.g., in the quads, backside, gluteus maximus) while reducing or eliminating pressure on the knees. The user may also straddle the board 12, placing their legs outside each side 52, and perform straddle squats to move from a standing to a sitting position in contact with the user support surface 18. In an embodiment, the user may simultaneously perform arm exercises using the strap(s) 102, e.g., moving their arms and/or shoulders inwardly and outwardly, relative to the squatting motions. In another exercise, the user may perform side stepping lunges by standing adjacent to the second (bottom) end of the exercise board 12 with their side positioned relative to the user support surface, and perform alternating lunges by alternately moving and placing each foot in a sideways motion onto a center or middle of the user support surface 18 and bending at the knee. The user may also position their head, arms, and upper body near the rounded top edge 50 and their lower body and feet toward the flat bottom edge 54, while placing their torso or back or backside adjacent to or against the user support surface 18, for example. The user may place their hands on the exercise board 12 near a first end and feet on the exercise board 12 at a second end to perform exercises such as mountain climbers or pushups. The user may also perform other exercises such as crunches and/or combinations of exercises, including lying with their back and backside on the exercise board 12 and curling using their abdominals followed by standing up from the board 12. Using the exercise board in this first position such as shown in FIG. 1 to perform crunches or curls reduces strain and stress on the user's body since the incline of the support surface 18 helps the user to focus the effort through their heels as they move from laying to standing. The user may also use the inclined support surface to support their feet and legs at an angle, while laying their back on the floor. The user may raise their backside and/or perform leg and/or abdominal exercises easily in such a position.

In accordance with an embodiment, the incline of the user support surface 18 may be adjusted via a ladder adjustment (beach chair) that enables movement of the top portion 60 in a longitudinal manner such that the incline may be moved to different levels or heights relative to the floor surface F.

When the support leg 22 is placed in an upwardly extending position (e.g., a second position such as shown in FIG. 9), the user may perform another set of exercises while balancing on the board 12 since the rocker surfaces 28, 30 are provided on the floor surface F. For example, in one exercise the user may sit with their backside on the support surface 18 at a second (bottom) side of the board 12 with their legs on the support surface 18 extending towards the first (top) side of the board 12. The user may grasp the strap(s) 102 and perform exercises such as abdominal crunches with arm movements. The user may also position themselves on the user support surface 18 to perform planks while balancing on the board 12. They may perform different variations of planks by placing their hands or arms on the support surface 18, or by grasping the support tube 22. Squats and/or lunges may also be performed using the board in this position. In other exercises, the user may position or lay on the user support surface 18 of the board 12 (via their back, sides, or front). The user may also perform exercises related to surfing or paddling in such a position. For example, the user may practice balancing on the board and moving from a laying position (laying with their front or torso and legs on the support surface 18 of the board 12) to a standing, surfing position (such that their feet are on the support surface 18). The user may also stand with their feet on the support surface 18 and perform rowing motions towards either side while balancing on the board 12. Additionally and/or alternatively, different yoga positions may be performed using the board 12 in this position, including practicing similar transitions between yoga positions (e.g., from lying to warrior pose) while still balancing on the user support surface 18.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. An exercise board assembly comprising:

an exercise board comprising a user support surface on a first side of the board and an opposite surface on a second side of the board opposite the first side;

a support leg pivotally mounted to the exercise board, the support leg constructed and arranged to be secured in at least two positions, including a deployed, downwardly extended position, wherein the support leg is arranged via contact with a floor surface to support the board in a stable angled configuration with respect to the floor surface on which the exercise board assembly is positioned, and a folded position wherein the support leg is out of contact with the floor surface; and a rocker surface constructed and arranged to support the exercise board on the floor surface when the support leg is in the folded position, the rocker surface being engageable with the floor surface to cause the user support surface to be unstable for a user supported thereby, wherein the rocker surface is provided on a rocker block, the rocker block being attached to the opposite surface of the exercise board, wherein the rocker block has a contact surface comprising a radius of curvature for contact with the floor surface, and wherein the rocker block is detachably mounted to the exercise board and is replaceable with another rocker block that has a different contact surface comprising a different radius of curvature.

2. The exercise board assembly according to claim 1, wherein the support leg has a portion thereof pivotally supported by the rocker block.

3. The exercise board assembly according to claim 2, wherein the portion of the support leg extends through an opening in the rocker block.

4. The exercise board assembly according to claim 1, further comprising a second rocker block, and a second rocker surface disposed on the second rocker block, the rocker block and the second rocker block being spaced from one another.

5. The exercise board assembly according to claim 4, further comprising a third rocker block, and a third rocker surface disposed on the third rocker block, the third rocker block being spaced from and provided between the second rocker block and the rocker block.

6. The exercise board assembly according to claim 1, wherein, in the folded position, the support leg extends generally alongside the opposite surface.

7. The exercise board assembly according to claim 1, wherein the rocker surface is curved.

8. The exercise board assembly according to claim 1, wherein, when in the folded position, the support leg is positioned such that the entire structure of the support leg is positioned closer to the opposite surface than at least a portion of the rocker surface.

9. The exercise board assembly according to claim 1, wherein the support leg is further configured to be secured in an upwardly extending position, wherein the support leg extends above the support surface so as to be engageable by the arms, hands, legs, or feet of the user.

10. The exercise board assembly according to claim 1, further comprising a second support leg pivotally mounted to the exercise board, the support leg constructed and arranged to be secured in at least two positions, including a deployed, downwardly extended position, wherein the support leg is arranged to support the board in a stable angled configuration with respect to the floor surface on which the exercise board assembly is positioned, and a folded position wherein the support leg extends generally alongside the opposite surface.

11. The exercise board assembly according to claim 1, wherein the exercise board further comprises longitudinal tubing mounted in a longitudinal direction on the opposite surface of the exercise board for rigidity and support.

12. The exercise board assembly according to claim 1, further comprising one or more stops on the second side of the exercise board to limit a range for rocking of the exercise board relative to the floor surface.

13. The exercise board assembly according to claim 1, further comprising a locking pin for securing the support leg in the at least two positions.

14. The exercise board assembly according to claim 1, further comprising a locking knob to secure the support leg in the at least two positions by friction.

15. The exercise board assembly according to claim 1, further comprising rubber feet.

16. The exercise board assembly according to claim 1, further comprising wheels.

17. The exercise board assembly according to claim 1, wherein the support leg is further configured to be secured in an extended position wherein at least a portion of the support leg is positioned to extend forwardly of the board away from the support surface.

18. An exercise board assembly comprising:

an exercise board comprising a user support surface on a first side of the board and an opposite surface on a second side of the board opposite the first side;

a support leg pivotally mounted to the exercise board, the support leg itself being constructed and arranged to be pivotally moved and secured in at least two positions, including a deployed, upwardly extended position, wherein the support leg is disposed in a position extending above the support surface to enable a user supported on the support surface to engage the support leg with the arms, hands, legs, or feet of the user, and a folded position wherein the support leg is out of contact with a floor surface; and a rocker surface constructed and arranged to support the exercise board on the floor surface when the support leg is in the deployed, upwardly extended position, the rocker surface being engageable with the floor surface to cause the user support surface to be unstable for a user supported thereby, wherein the support leg is further configured to be secured in a third position wherein at least a portion of the support leg is positioned on the second side of the board in a manner that supports the board in an angled configuration with respect to the floor surface.

19. The exercise board assembly according to claim 18, wherein, in the folded position, the support leg is folded alongside the exercise board to provide a more compact configuration to the exercise board assembly than a configuration when the support leg is in the deployed, upwardly extended position, to facilitate storage thereof.

20. The exercise board assembly according to claim 18, wherein the rocker surface is curved.

21. The exercise board assembly according to claim 18, wherein the rocker surface is provided on a rocker block, the rocker block being attached to the opposite surface of the exercise board.

22. An exercise board assembly comprising:

an exercise board comprising a user support surface on a first side of the board and an opposite surface on a second side of the board opposite the first side;

a support leg pivotally mounted to the exercise board, the support leg constructed and arranged to be secured in (a) a deployed, downwardly extended position, wherein the support leg is arranged to support the board in a stable angled configuration with respect to a floor surface on which the exercise board assembly is positioned, (b) a folded position, and (c) an upwardly extending position, wherein the support leg extends above the support surface so as to be engageable by the arms, hands, legs, or feet of a user; and a rocker surface constructed and arranged to support the exercise board on the floor surface when the support leg is in the folded position, the rocker surface being engageable with the floor surface to cause the user support surface to be unstable for the user supported thereby.

23. An exercise board assembly comprising:

an exercise board comprising a user support surface on a first side of the board and an opposite surface on a second side of the board opposite the first side;

a support leg pivotally mounted to the exercise board, the support leg constructed and arranged to be secured in (a) a first, deployed, upwardly extended position, wherein the support leg is disposed in a position extending above the support surface to enable a user supported on the support surface to engage the support leg with the arms, hands, legs, or feet of the user, (b) a second folded position, and (c) a third position wherein at least a portion of the support leg is positioned on the second side of the board in a manner that supports the board in an angled configuration with respect to a floor surface; and a rocker surface constructed and arranged to support the exercise board on the floor surface when the support leg is in the deployed, upwardly extended position, the rocker surface being engageable with the floor surface to cause the user support surface to be unstable for the user supported thereby.

* * * * *